US006412654B1

(12) United States Patent
Cleeve

(10) Patent No.: US 6,412,654 B1
(45) Date of Patent: Jul. 2, 2002

(54) VENDING MACHINE

(75) Inventor: Keith Francis Cleeve, North Balwyn (AU)

(73) Assignee: Australian Central Finance Pty Ltd, Melbourne (AU)

( * ) Notice: Subject to any disclaimer, the term of this patent is extended or adjusted under 35 U.S.C. 154(b) by 0 days.

(21) Appl. No.: 09/581,149

(22) PCT Filed: Dec. 10, 1998

(86) PCT No.: PCT/AU98/01024

§ 371 (c)(1),
(2), (4) Date: Jun. 9, 2000

(87) PCT Pub. No.: WO99/30296

PCT Pub. Date: Jun. 17, 1999

(30) Foreign Application Priority Data

Dec. 10, 1997 (AU) ..... PP0818
Apr. 6, 1998 (AU) ..... PP2814

(51) Int. Cl.[7] ..... G07F 11/00

(52) U.S. Cl. ..... 221/7; 221/8; 221/123; 221/131; 221/133; 221/195; 221/236; 221/261; 221/301

(58) Field of Search ..... 221/123, 126, 221/127, 131, 133, 6, 7, 8, 2, 197, 191, 195, 196, 236, 261, 263, 268, 289, 290, 292, 293, 298, 301, 312 R; 194/906; 414/787, 273

(56) References Cited

U.S. PATENT DOCUMENTS 1,940,909 A * 12/1933 Hermani ..... 221/301
3,702,665 A * 11/1972 Rainey ..... 221/301
3,893,589 A * 7/1975 Mandell ..... 221/123
4,301,909 A * 11/1981 Snavely ..... 221/123
4,782,979 A * 11/1988 Smith ..... 221/236
4,809,881 A * 3/1989 Becker ..... 221/236
5,111,965 A * 5/1992 Allen et al. ..... 221/290
5,791,512 A 8/1998 Kanatsuka

FOREIGN PATENT DOCUMENTS

DE 2 656 820 * 6/1978 ..... 221/298

* cited by examiner

*Primary Examiner*—H. Grant Skaggs

(57) ABSTRACT

A vending machine for vending articles such as cassettes or boxes is disclosed which has a touch screen (18) for receiving user input commands, a key pad (26) and credit card or coin payment devices (22, 24). A control system (FIGS. 11 to 13 and 23) controls operation of the machine. A vending unit (14) has a carriage (70) mounted for movement below a storage compartment (46) which is divided into a plurality of sections (74). The compartment (46) stores cassettes or boxes which can be stacked one above the other and released into the carriage (70) so that the carriage (70) can move to dispense the article through an outlet (58). A latch (80) controls movements of the cassettes or boxes (75) into the carriage (70). The latch (80) is pivotally mounted and movable from a position where abutment (196) engages a cassette or box (75) or releases the cassette or box. When in the release position a top portion (181) of the latch engages the cassette or box above the cassette or box to be released and holds that cassette or box in place until the lower most cassette or box is released and then return of the latch (80) enables the next box to drop down to be engaged by the abutment portion (196) and held in the storage compartment (46). The carriage (70) has an open bottom and articles can be delivered to an outlet opening (58) in the floor for dispensing through the outlet opening or the outlet opening (58) could be aligned with the floor and articles tipped onto a front face by an abutment (505) and rearward movement of the carriage (70) and then pushed out of the outlet opening (58) by the carriage (70).

47 Claims, 19 Drawing Sheets

52
50
52
48
A
49
171
46
79
78
78
78
167
78
163
161
80
54
C
165
95
70
101
B
14
60
159
58
137

VENDING MACHINE

This invention relates to a vending machine for vending articles and, in particular, those which have a regular shape. The invention has particular application to the vending of compact discs but, as will be apparent, the vending machine could be used to vend other articles if desired or required.

Vending machines generally comprise a storage compartment in which articles to be sold are kept. Upon purchase of an article, the vending machine generally moves the article to a position by means of a spiral wire or by opening a door to enable the article to fall under the influence of gravity to an outlet opening for collection by the purchaser. If spiral wires are used to bend articles, a separate motor for each wire is required which increases cost and size. Conventional vending machines are not suitable for the vending of compact discs. The main reason for this is due to the number of discs which would need to be maintained in the vending machine to make the machine viable for the vending of compact discs. Conventional storage systems would not store a large number of different discs unless the storage space and therefore the vending machine was extremely large. Furthermore, the dispensing technique of merely allowing the article to drop a significant distance under gravity is also not suitable for compact discs because of the possibility of cracking or breaking of the cases if the discs are handled in that manner.

The object of the present invention is to provide a vending machine for vending articles such as compact discs.

The invention may be said to reside in a vending machine for vending articles, including:

- user input means for allowing a user to input information relating to purchase of one of the articles;
- payment receiving means for receiving payment relating to purchase of the article;
- a vending unit for storing the articles and for dispensing the articles to a purchaser;
- control means coupled to the vending unit, the user input means and the payment receiving means for receiving data from the user input means concerning the article to be purchased, determining that payment has been made and for causing the vending unit to dispense the article; and
- wherein the vending unit includes:
  - a storage compartment for storing a plurality of the articles;
  - or a carriage mounted below the storage compartment and movable relative to the storage compartment, the carriage having an open bottom;
  - a floor below the open bottom of the carriage;
  - an outlet opening in the floor;
  - moving means for moving the carriage to align the carriage with a particular one of the articles stored in the storage compartment and then to the outlet opening after receipt of the article; and
  - release means for releasing the article from the storage compartment so the article falls under the influence of gravity into the aligned carriage so that the carriage can receive the article and transport the article to the outlet opening with the article sliding on the floor and dropping from the carriage through the outlet opening when the carriage arrives at the outlet opening to thereby dispense the article.

Since the vending unit includes the storage compartment and the carriage which is moved to receive an article a large number of articles can be stored in a relatively small area for collection by the carriage and for movement to the dispensing station and since the carriage receives the article and transports the article to the dispensing station, articles can be dispensed without articles having to free fall a significant distance under the influence of gravity.

Preferably the storage compartment includes a plurality of sections so that articles can be stacked in the sections one above the other.

Preferably the release means comprises a pivotally mounted latch for holding the aligned articles in each section.

Preferably the carriage is mounted for movement below the compartment and includes a plunger for contacting the latch moving the latch to release the article so the article can drop into the carriage for transportation to the dispensing station.

Preferably the plunger includes a solenoid for moving the plunger from a retracted position to an extended position so that in the extended position the plunger engages the latch and pivots the latch out of engagement with the article to enable the article to drop into the carriage.

Preferably the carriage is coupled to an endless belt and the belt is driven by a stepping motor to drive the carriage beneath the storage compartment into registry with a particular one of the articles stored in the storage compartment.

Preferably the carriage includes a wheel for facilitating movement of the carriage.

Preferably the carriage includes:

- a sensor for determining the position of the carriage beneath the storage compartment,
- a sensor for detecting when the carriage is in a home position;
- a sensor for determining whether an article is within the carriage; and
- a sensor for determining whether articles are stored in the sections of the storage compartment.

Preferably the sensors are optical sensors.

Preferably the carriage has an open bottom so that when an articles is received in the carriage, the article contacts a floor of the vending unit for sliding movement on the floor when the carriage transports the article to the dispensing station.

Preferably the dispensing station comprises an opening in the floor of the unit so that when the carriage is brought into registry with the opening, the article is able to fall from the carriage through the opening for collection by the purchaser.

Preferably the opening is closed by a spring biased closure door which is open by the carriage when the carriage moves into registry with the opening.

Preferably the user input means comprises a touch screen which displays information so that the user can input commands by touching the screen in response to the information displayed on the screen. Preferably the user input means also includes a pindad for input of information into the pinpad.

Preferably the payment receiving means comprises a card reader for receiving a financial transaction card such as a credit card or EFTPOS card or smart card for enabling payment in respect of the article. However, in other embodiments, the payment receiving means could comprise coin or note slots for receipt of coins or notes in order to make the payment.

The invention also provides a vending machine for vending articles, including:

- user input means for allowing a user to input information relating to purchase of one of the articles;
- payment receiving means for receiving payment relating to purchase of the article;

a vending unit for storing the articles and for dispensing the articles to a purchaser;

control means coupled to the vending unit, the user input means and the payment receiving means for receiving data from the user input means concerning the article to be purchased, determining that payment has been made and for causing the vending unit to dispense the article; and wherein the vending unit includes:

a plurality of storage compartments each for storing articles stacked one above another;

a carriage movable relative to the storage compartments;

moving means for moving the carriage to align the carriage with a particular one of the articles stored in the storage compartment;

a latch associated with each of the plurality of storage compartments, each latch having an engaging portion for engaging a lowermost one of the articles stacked in each plurality of storage compartments and for holding the articles, and each latch having a retaining portion so that when the latch is moved to withdraw the engaging portion from the lowermost article to release the lowermost article, the retaining portion is moved concurrently into engagement with the article above the lowermost article to hold the article above the lowermost article and any articles above that article so that only the lowermost article is dispensed from the respective storage compartment and upon return of the latch the retaining portion disengages so that the articles can drop under the influence of gravity and be held by the engaging portion within the storage compartment.

The invention still further provides a vending machine for vending articles, the articles having a bottom and a front face, including:

user input means for allowing a user to input information relating to purchase of one of the articles;

payment receiving means for receiving payment relating to purchase of the article;

a vending unit for storing the articles and for dispensing the articles to a purchaser;

control means coupled to the vending unit, the user input means and the payment receiving means for receiving data from the user input means concerning the article to be purchased, determining that payment has been made and for causing the vending unit to dispense the article; and wherein the vending unit includes:

a storage compartment for storing a plurality of the articles with the bottom being substantially horizontal and the front face being substantially vertical;

a carriage mounted below the storage compartment and movable relative to the storage compartment, the carriage having an open bottom;

a floor below the open bottom of the carriage;

an outlet opening;

moving means for moving the carriage to align the carriage with a particular one of the articles stored in the storage compartment and then toward the outlet opening after receipt of the article;

an abutment adjacent the floor so that when the carriage moves the article over the abutment the article drops in front of the abutment, the moving means being for reversing movement of the carriage so that the article is drawn backwards and is tipped, by the backward movement of the carriage and engagement of the article with the abutment, onto the front face of the article to remove the article from the carrier; and dispensing means for dispensing the article out of the vending unit through the opening.

Preferably, the dispensing means comprises the carriage which, after the article is removed from the carriage during backward movement of the carriage, the carriage is moved towards the opening by the moving means to push the tipped article through the opening.

Preferably, the floor has a plurality of strips and the abutment is formed by an end of the strips spaced from the outlet opening so that when the carriage is moved towards the outlet opening the bottom of the article slides on the strips and then drops over the end of the strips as the carriage passes over the end of the strips.

Preferably, the carriage has a front flap movable from a closed position to an open position as the carriage moves backwards to enable the article to be removed from the carriage as the article is tipped by the abutment during backward movement so the carriage.

Preferred embodiments of the invention will be described, by way of example, with reference to the accompanying drawings in which.

Figure 1:
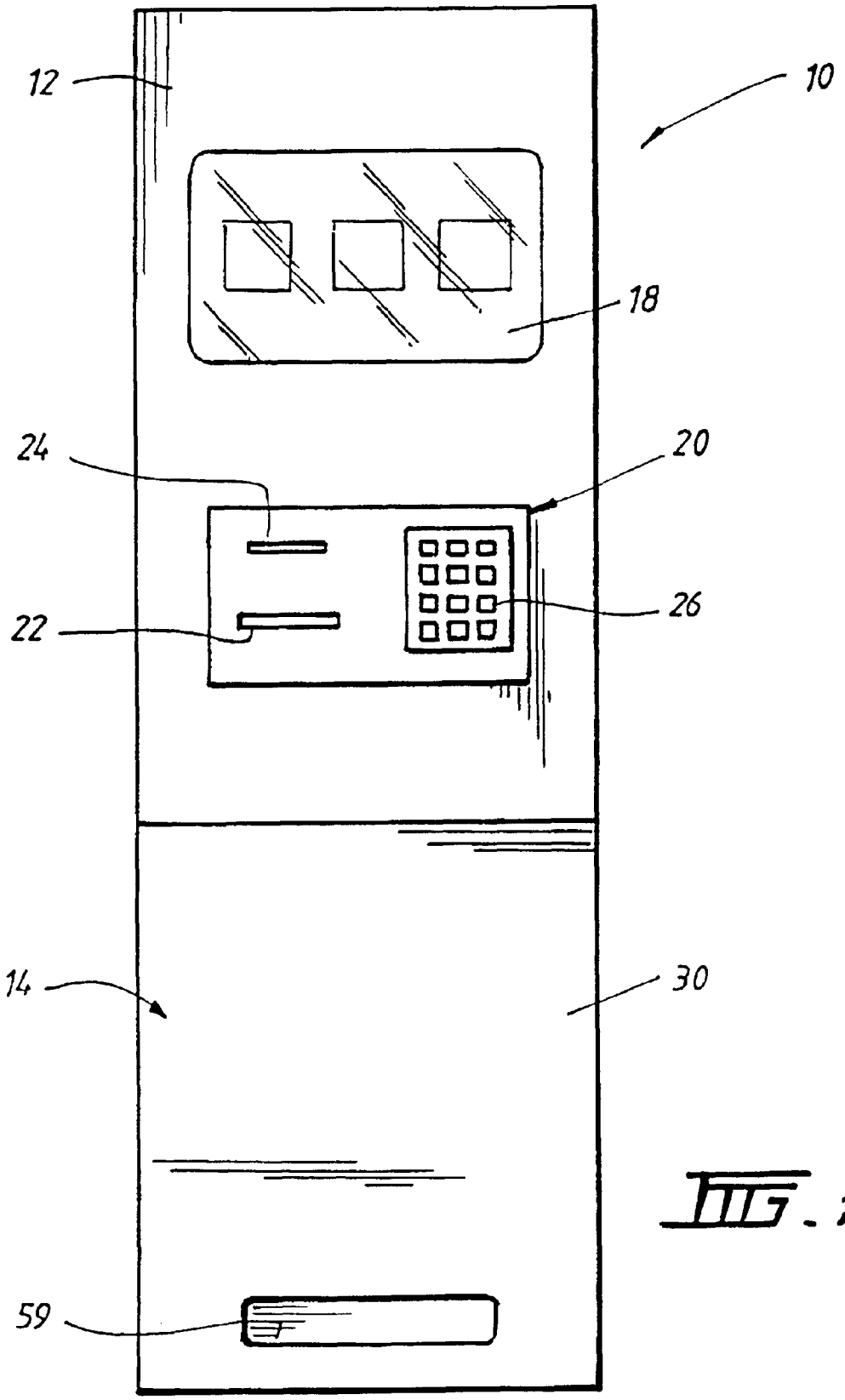
FIG. 1 is a front view of a vending machine according to one embodiment.

With reference to FIG. 1, a vending machine 10 of the preferred embodiment is shown. The vending machine 10 has an outer housing 12 which houses a vending unit 14, a touch screen 18 and a vending terminal 20. The vending terminal 20 includes a slot 22 of a card reader (not shown in FIG. 1) for receipt of a credit card or EFTPOS card to enable payment for a purchase from the vending machine. A printer outlet 24 is provided for providing a printed receipt and a keypad 26 is provided for input of information if required.

The touch screen 18 can be touched by a purchaser to input commands relating to the purchase of a particular article such as a compact disc from the vending machine 10. The storage unit 14 includes a lockable door 30 which can be opened to enable access to the vending unit to load articles such as compact discs into the vending unit 14 and also for maintenance purposes.

The vending machine 10 may also have openable doors or compartments (not shown) to enable access to the interior of the vending unit for maintenance it respect of the video monitor 18 and the terminal 20 as well as control circuitry (which will be described in more detail hereinafter) contained within the housing 12.

Figure 2:
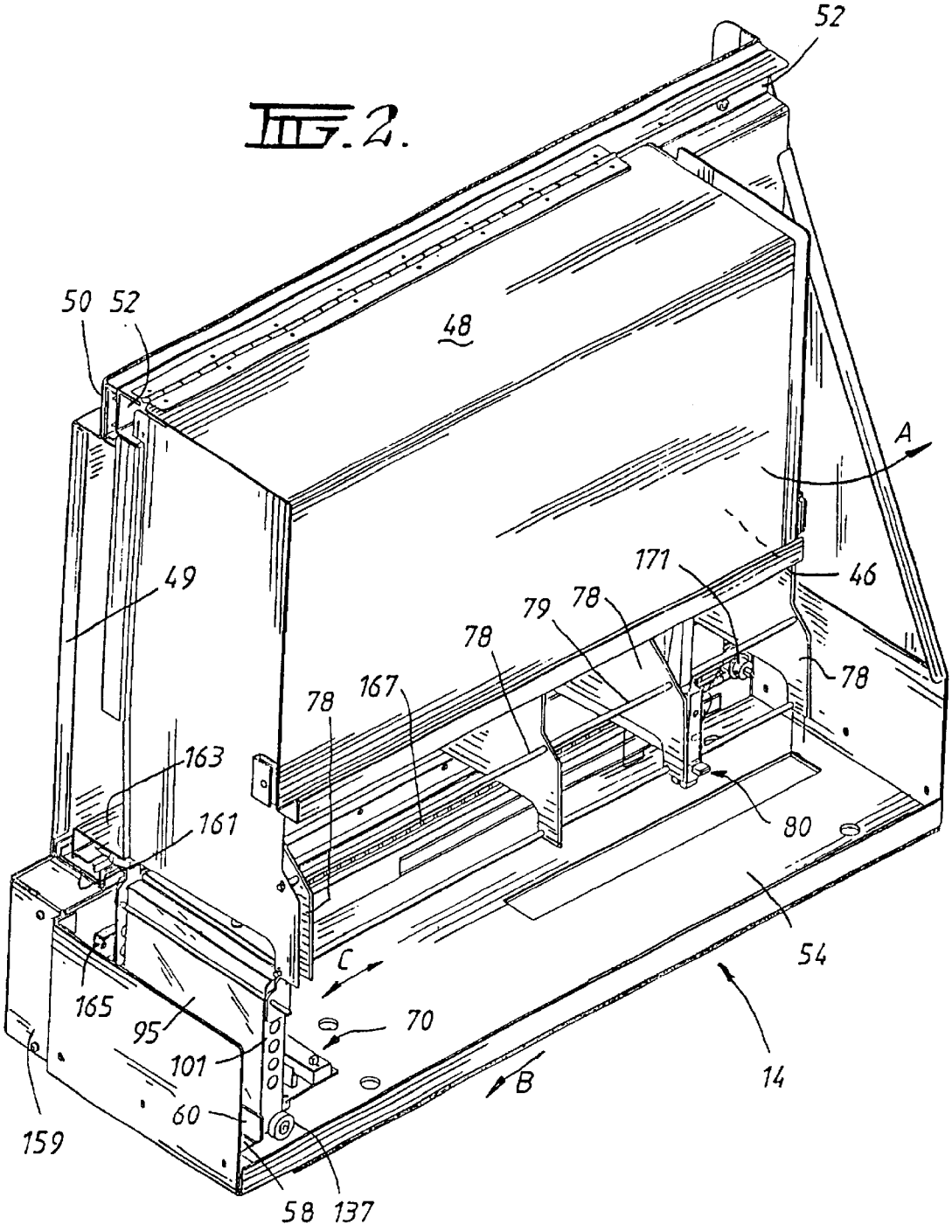
FIG. 2 is a perspective view of a vending unit according to the embodiment of FIG. 1.

FIG. 2 is a view of the vending unit 14 within the housing 12. The vending unit 14 has a storage compartment 46 which is closed by a door 48 which can be pivoted upwardly in the direction of arrow A in FIG. 2 to gain access to the storage compartment 46.

The compartment 46 can slide in and out of the housing 12 in the direction of arrow B in FIG. 2. The housing 12 includes a rear wall portion 49 which includes a U-shaped track 50 which receives a correspondingly shaped rail 52 connected to the compartment 46. Thus, the compartment 46 can be drawn out of the housing 12 in the form of a drawer so that the door 48 can be opened to enable loading of compact discs into the storage compartment 46.

The vending unit includes a floor 54 which is formed From or covered with a generally slippery material such as plastics material or the like to enable sliding movement Om a compact disc along the floor 54 as will be described in more detail hereinafter.

The floor 54 has a rectangular dispensing opening 58 which is closed by a spring biased closure 60. The closure 60 is biased into a position covering the opening 58 so that people cannot attempt to reach up through the opening 58 and steal articles stored in the storage compartment 46. The opening 58 is in registry with a dispensing outlet 59 (see FIG. 1) so that articles dispensed by the vending machine 10 can be collected by the purchaser.

Arranged below the storage compartment 46 is a carriage 70. The carriage 70 is movable in the direction of double headed arrow C in FIG. 2 relative to the compartment 46 for receiving an article from the storage compartment 46 and transporting the article to the dispensing opening 58 for dispensing to the purchaser.

With further reference to FIGS. 3, 4, 5 and 6 which show the storage compartment 46 with the door 48 effectively open or removed, a number of sections 74 are provided within the storage compartment 46 for storing compact discs 75. In the drawings, only one of the sections 74 is shown including compact discs for ease of illustration. Each of the sections 74 would house a different compact disc and in the embodiment shown in the drawings, three compact discs of the same type are in each section 74 with the compact discs being stacked one above the other in the sections 74. The sections 74 are defined by plates 78 (see FIG. 2 which shows only some of the plates 78 also for ease of illustration) so that the sections 74 are in the form of narrow spaces defined by the plates 78 which are substantially the thickness of a compact disc. It should be noted that the plates 78 are only schematically shown in FIGS. 3 and 6 once again for ease of illustration.

A pivot rail 79 passes through the plate 78 as best seen in FIG. 2 for mounting of a retaining latch 80 (which will be described in more detail with reference to FIG. 10).

Thus, according to the preferred embodiment, compact discs are loaded into each of the sections 74 so that each section 74 includes three compact discs of the same type.

Figure 3:
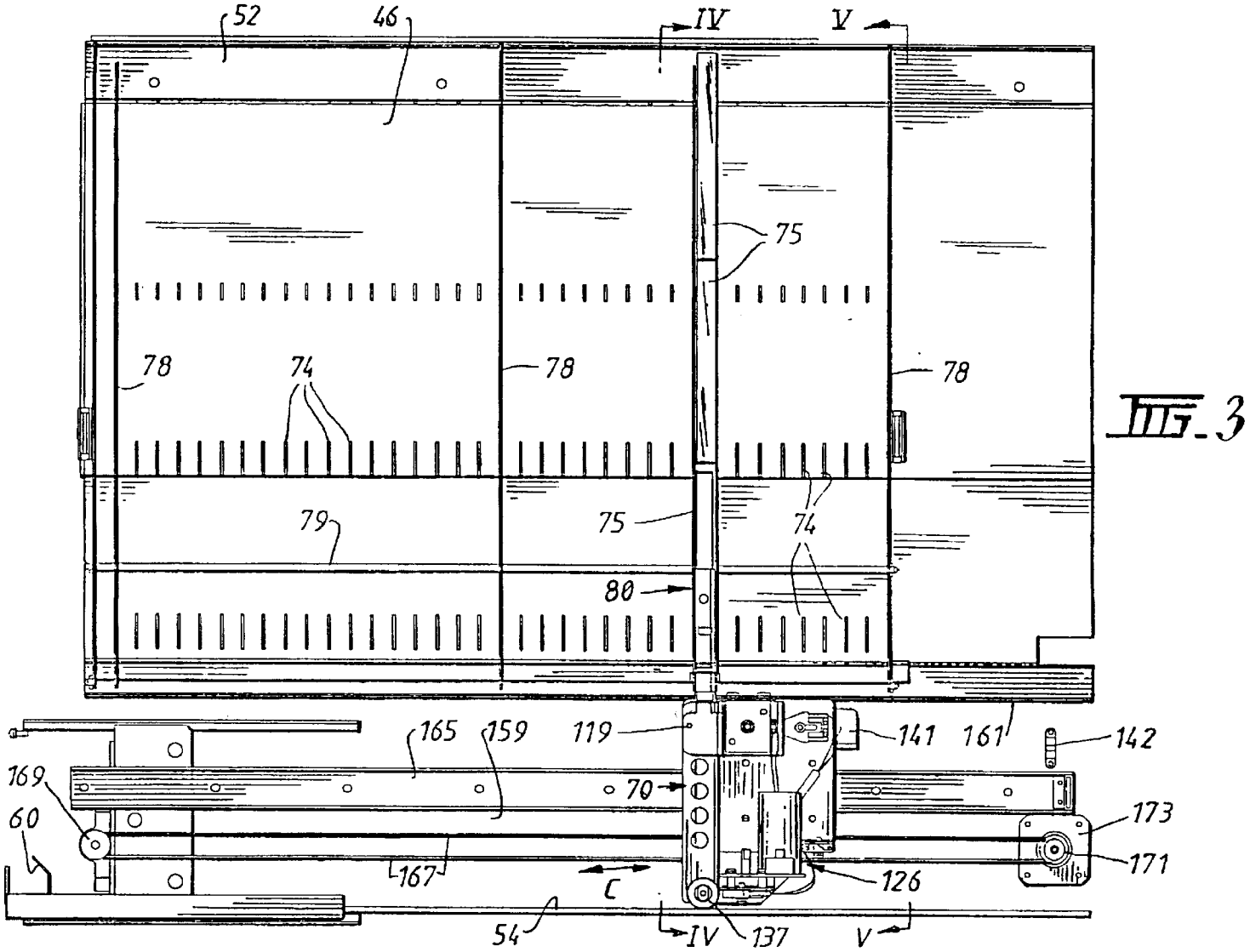
FIG. 3 is a side view of the vending unit of FIG. 2 partly broken away to show internal detail.

The carriage 70 is movable relative to the storage compartment 48 in the direction of double headed arrow C in FIGS. 2 and 3 so that the carriage 70 can move into registry with one of the sections 74 to receive a compact disc from that section 74 and then transport the compact disc to the dispensing opening 58.

Figure 7:
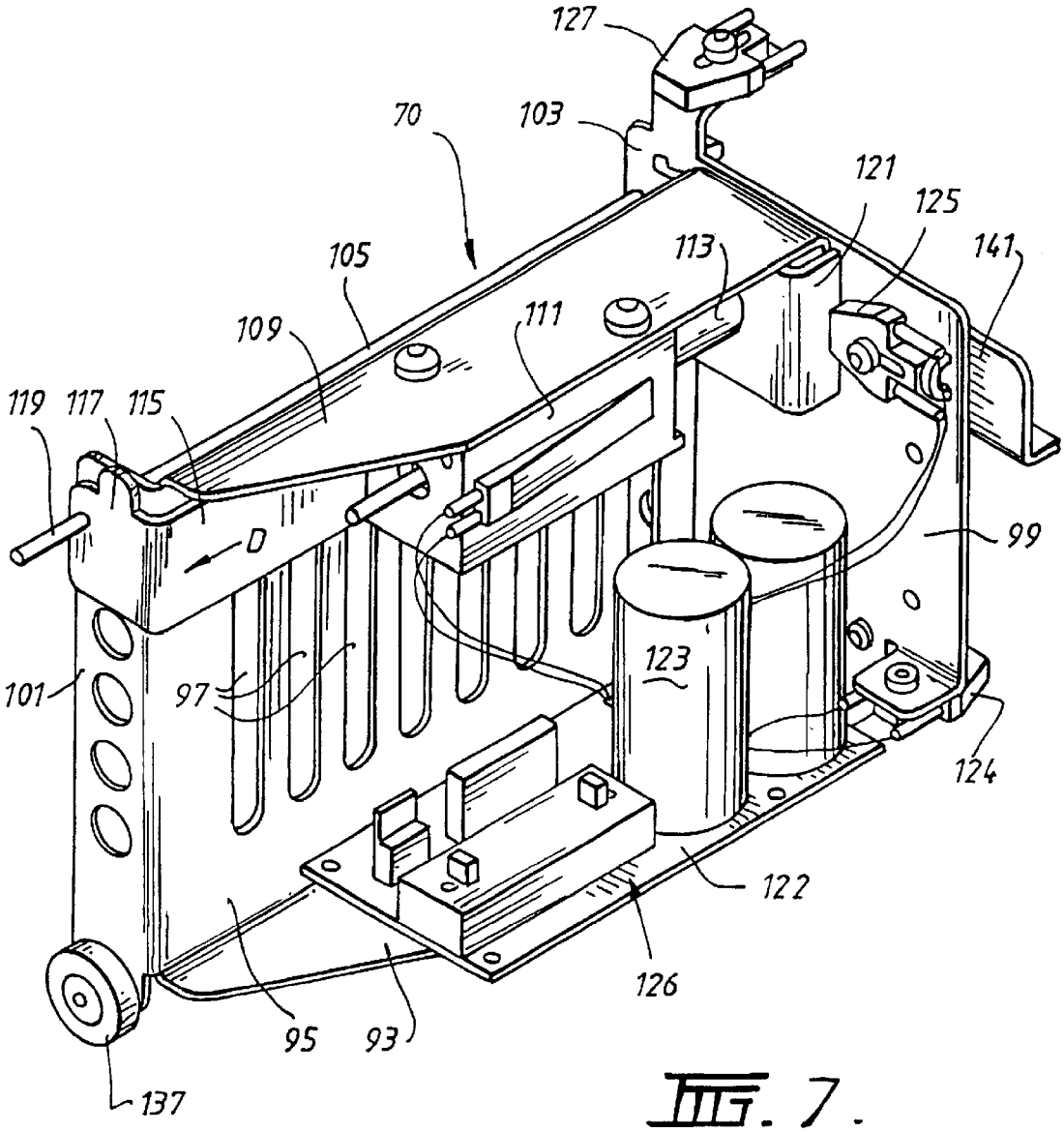
FIG. 7 is a rear view of a carriage used in this embodiment of the invention.
Figure 9:
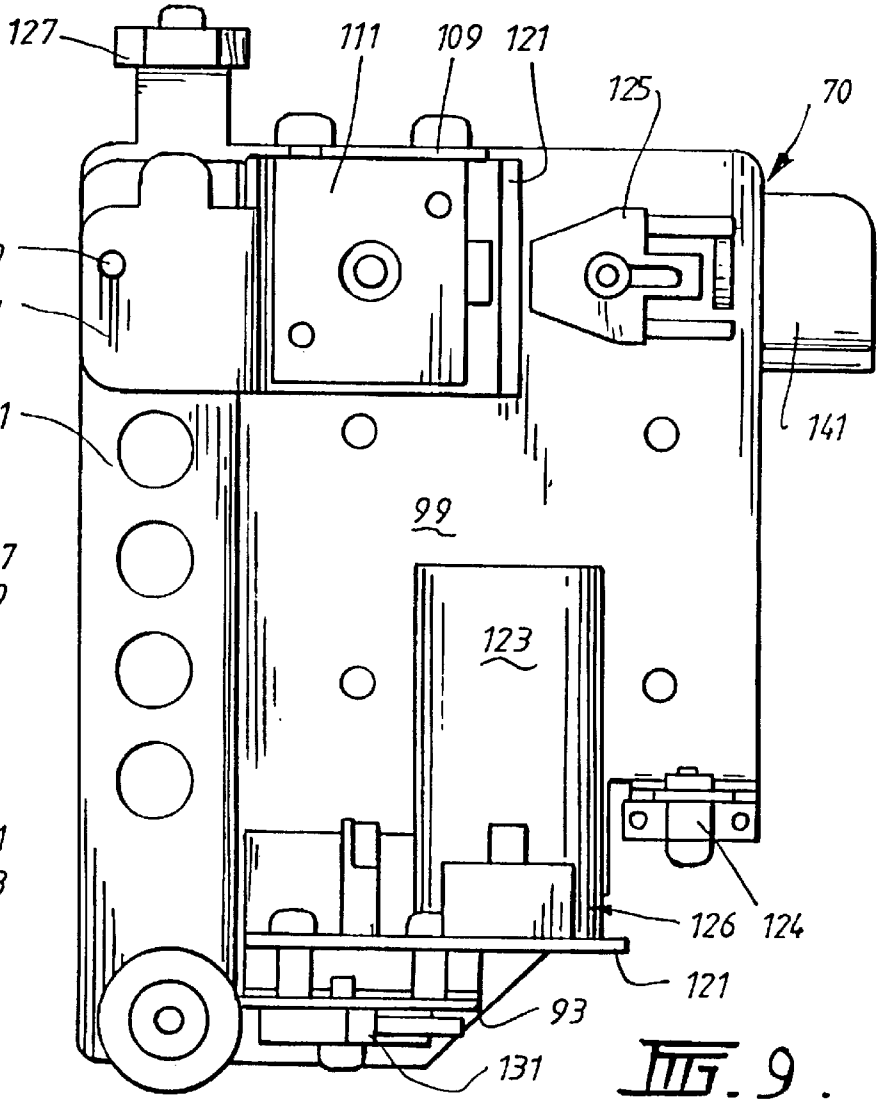
FIG. 9 is a side view of the carriage of FIGS. 7 and 8.
Figure 8:
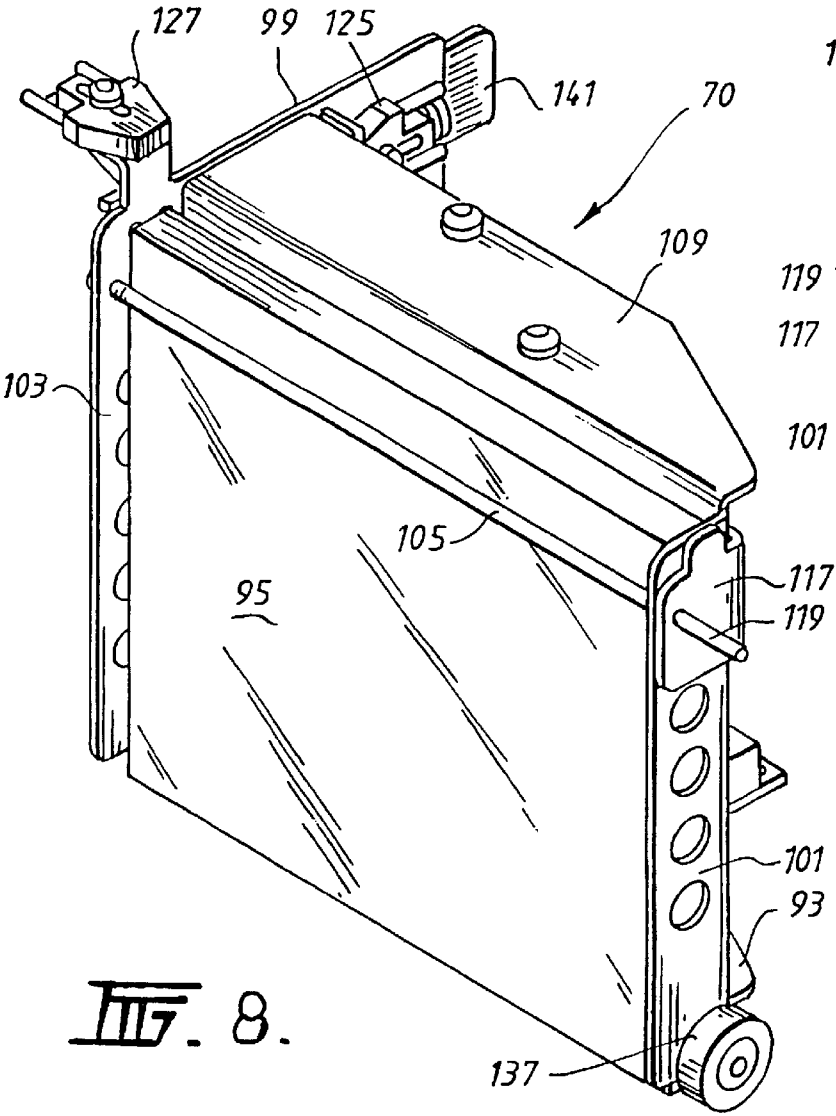
FIG. 8 is a front view of the carriage of FIG. 7.

The carriage 70 is shown in more detail in FIGS. 7, 8 and 9. With reference to FIGS. 7, 8 and 9, the carriage 70 has a base plate 93 and an upstanding front wall 95. The troth wall 95 may include slots 97 simply to reduce material and weight. The carriage 70 has a side wall 99 which may be integral with the front wall 95 or connected to the front wall 95. The base 93 is connected to the front wall 95 and the side wall 99. The front wall 95 has two forwardly projecting side walls 101 and 103. A rail 105 is arranged between the walls 101 and 103 and is spaced from the front wall 95 by a distance slightly greater than the thickness of a compact disc to be dispensed by the vending unit 14. The carriage also has an upper wall 109 which is integral with the front wall 95. Mounted to the bottom of the upper wall 109 is a solenoid 111. The base wall 93 supports a solenoid driver board 121 which carries electronic componentry for activating the solenoid 111. The componentry can include capacitors 123 and other componentry and connectors generally designated by the reference 126. The solenoid 111 has an armature 113. A plunger 115 is arranged between the front wall 95 and the solenoid 111 and includes a flange 117 which includes a finger 119 which projects outwardly from the flange 117. The plunger 115 also has a base portion 121 which is connected to the armature 113 of the solenoid 111. Thus, when the solenoid 111 is activated, the plunger 115 is moved with the armature 113 so as to move the plunger from a retracted position shown in FIG. 7 in the direction of arrow D to an extended position to enable a compact disc to be released from the storage compartment 46 as will be described in more detail hereinafter.

The side wall 99 supports an optical sensor 124 for detecting the position of the carriage and for supplying signals back to a controller which will he described with more detail with reference to FIGS. 11 to 14.

The side wall 99 also carries second sensor 125 for determining the position of the plunge 115 so that information can be provided to the controller to ensure that the plunger 115 is operating correctly. A third optical sensor 127 is also carried at the top of the side wall 99 for determining whether compact discs are located in each section 74 of the compartment 46. Finally, a fourth sensor 131 (see FIG. 9) is provided at the bottom of the base plate 93 for determining whether a compact disc has been correctly loaded into the carriage 70 as will be described in more detail hereinafter.

The side wall 99 also carries a sensor bar 141 for registry with a sensor 142 (see FIG. 3) so that the plate 141 can be received within the sensor 142 for indicating that the carriage 70 is at the rear of the vending unit 46 shown in FIG. 3 which defines a home position.

The side wall 101 also carries a wheel 137 for engaging the floor 54 of the unit 14 and for enabling the carriage to move along the floor 54 in the direction of double headed arrow C.

Returning to FIGS. 2 to 6, arranged below the wall portion 49 of the housing 12 is a housing section 159. The housing section 159 mounts a further channel 161 for receiving a rail 163 to facilitate movement of the storage compartment 46 out of the housing 12 as previously described. The housing section 159 also supports a U-shaped channel 165 which receives a bearing block 172 (see FIGS. 4 and 5) connected to the s de wall 99 of the carriage 70 for facilitating movement of the carriage in the direction of double headed arrow C in FIG. 2.

Housing section 159 also mounts a stepping motor 173 which has a pulley 171. A pulley 169 is arranged at the opposite end of the housing section 159 and an endless belt 167 passes around the pulleys 169 and 171. The carriage 70 is connected to the endless belt 167 by coupling the side wall 99 to the endless belt 167.

The stepping motor 173 receives control commands from the controller to be described with reference to FIGS. 11 and 14 and therefore moves the belt 167 to in turn move the carriage 70 in the direction of double headed arrow C with the bearing block (172) being guided in the channel 165 and the carriage rolling on the wheel 137. By appropriate control of the steeping motor 173, the carriage 70 can be moved into registry with any one of the sections 74 of the storage compartment 46 to receive a compact disc 75 from the storage compartment 46. Thus, depending on the selection of the compact disc which is made by the purchaser, the controller will move the carriage 70 into registry with the section 74 which holds those compact discs. so that one of the compact discs can be loaded into the carriage 70 and moved to the opening 58 for dispensing to the purchaser.

Figures 10, 11:
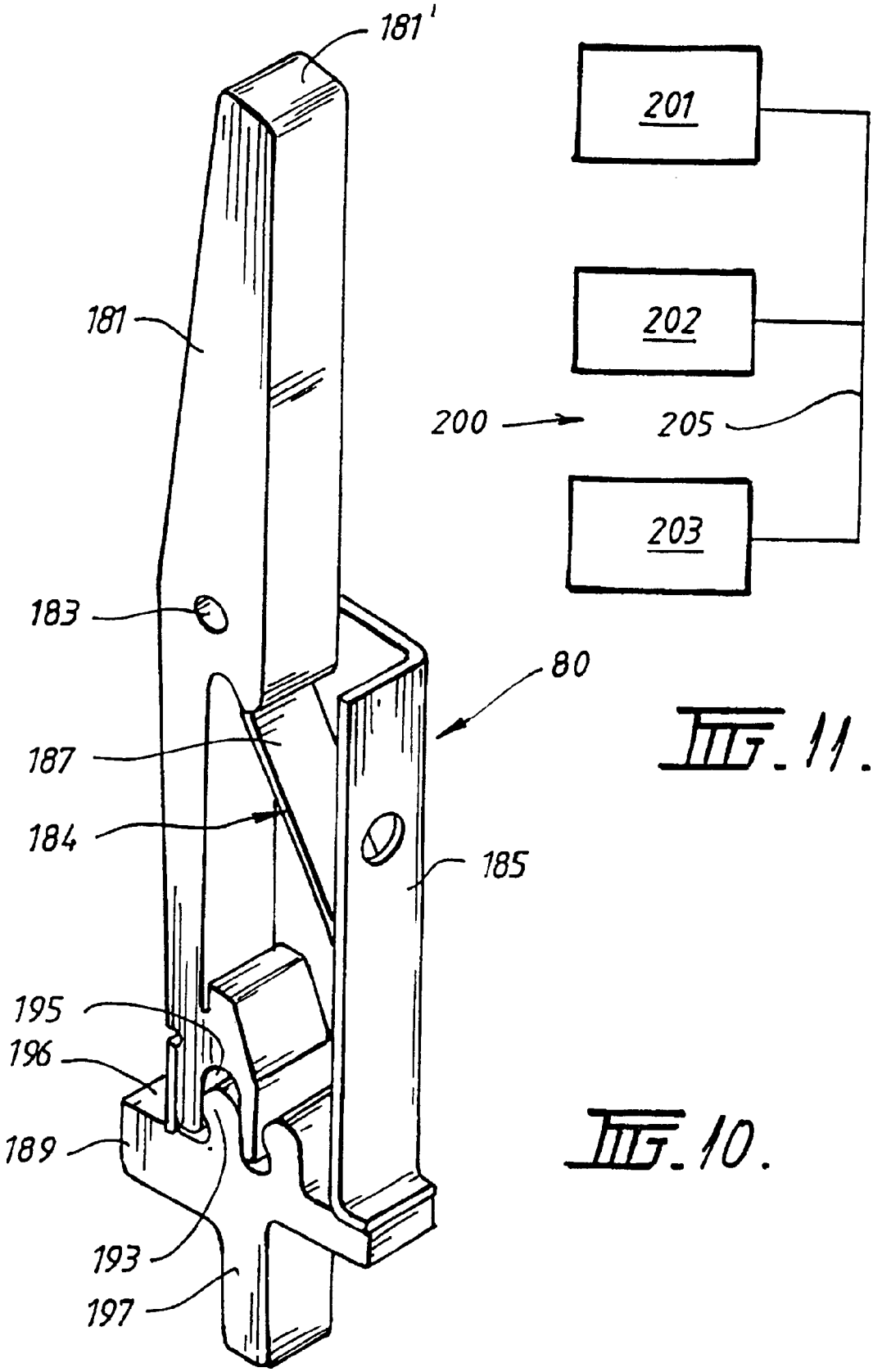
FIG. 10 is a view of an abutment member for release of articles used in this embodiment of the invention.
FIG. 11 is a block diagram showing the electronic control of this embodiment.

In order to hold the compact disc 75 in the sections 74 between the plates 78, latches 80 shown in FIG. 10 are pivotally mounted on the rod 79. Each of the sections 74 has one of the latches 80 (only one being shown in FIG. 6) for holding the compact discs within the sections 74.

Figure 4:
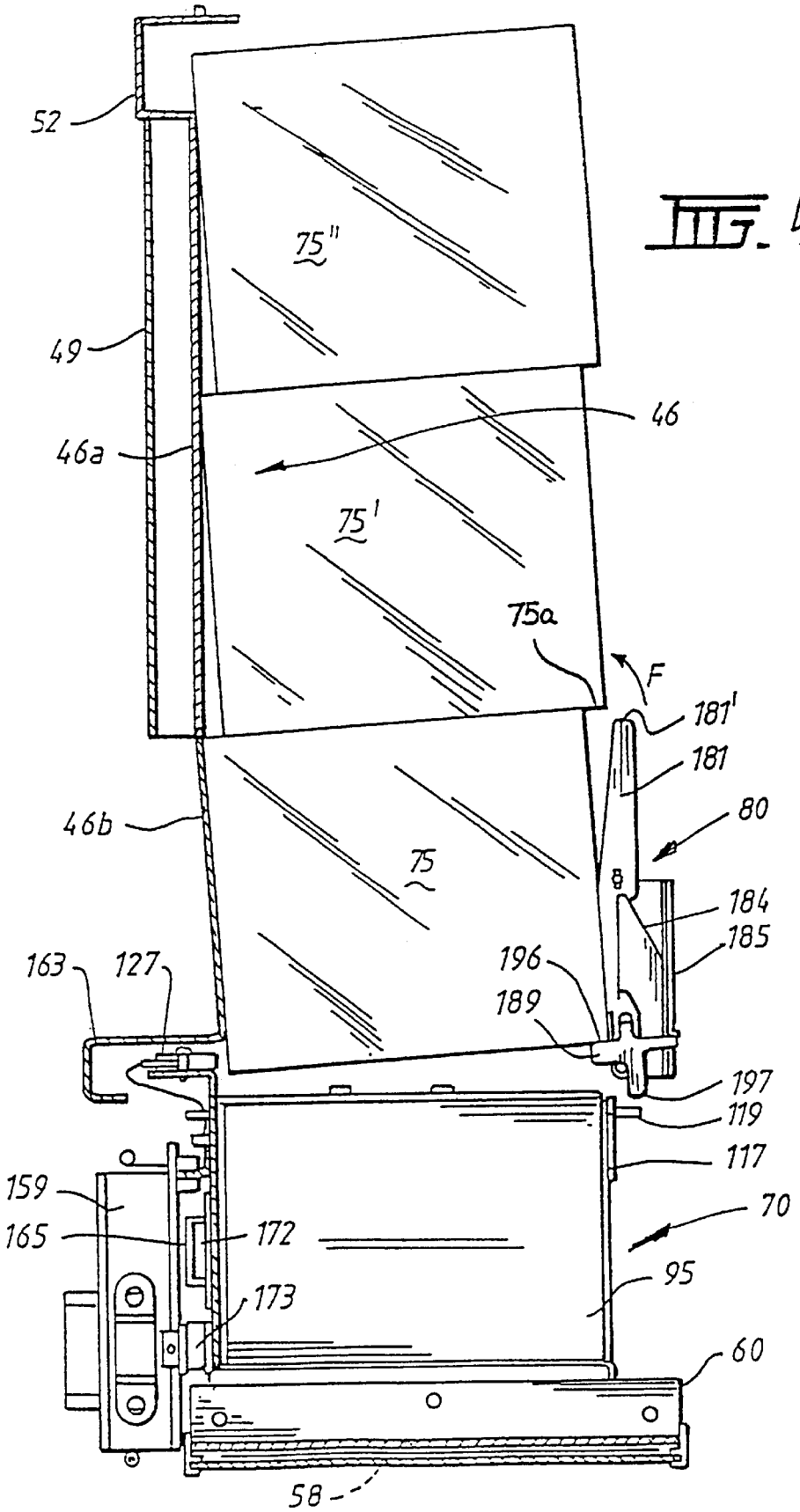
FIG. 4 is a view along the line IV—IV of FIG. 3.
Figure 5:
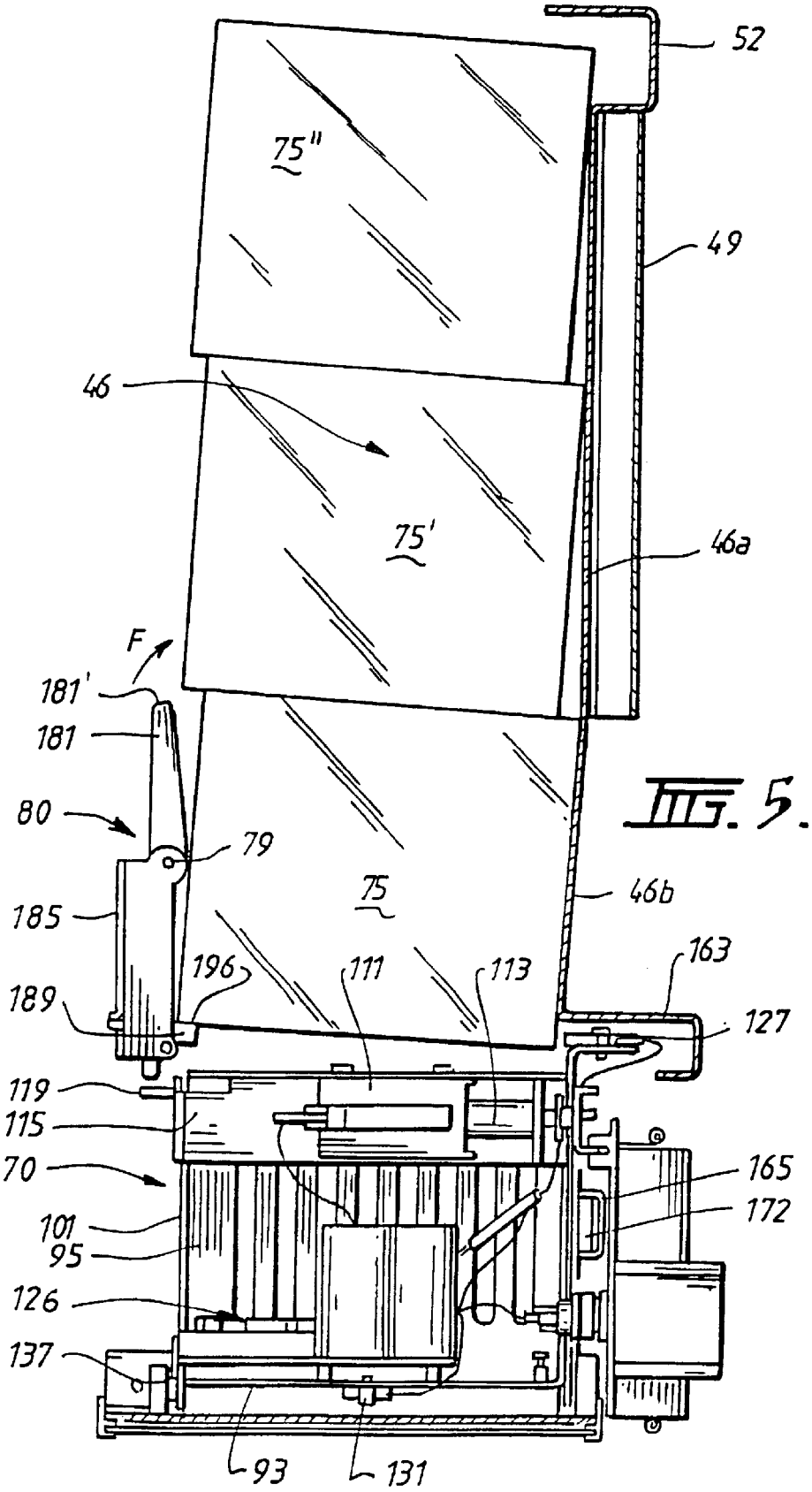
FIG. 5 is a view along the line V—V of FIG. 3.

As shown in FIG. 10, the latch 80 comprises an arm 181 which has a hole 183 so that the rod 79 can pass through the hole 183 to pivotally mount the arm 181. The arm 181 has a spring section 184 which comprises a L-shaped plate 185 which is fixed to the compartment 46. A leaf spring 187 is arranged between the arm 181 and the plate 185 for biasing the arm into the position shown in FIG. 10. The arm 181 carries an abutment section 189 which could be integral with the arm 181 but in the embodiment shown is a separate component which includes a boss 193 which is a friction fit in a slot 195. The section 189 carries a depending abutment portion 197 for engagement with the finger 119 carried by the plunger 115. The portion 189 has a ledge 196,which protects into the sections 74 and holds the compact discs 75 in the section 74 as is best shown in FIGS. 4 and 5. When the finger 119 contacts the portion 197, the arm 181 is pivoted on the rod 79 against the bias of the spring 187.

The arm 181 has a flat upper surface 181' which serves to hold the compact discs stacked above the lowermost compact disc when the lowermost compact disc is dispensed into the carriage 70. As is best shown in FIGS. 4 and 5, the storage compartment 46 has a rear wall section **46*a* which extends vertically and then a rear wall section 46*b* which extends down at an inclined angle of approximately 3° to the vertical. The inclined wall 46*b* causes the lowermost cassette 75 shown in FIGS. 4 and 5 to be tilted slightly so that the bottom edge of the compact disc is supported by the ledge 196 as clearly shown in FIGS. 4 and 5. The compact discs labelled 75' and 75" in FIGS. 4 and 5 above the disc 75 are also supported on an inclined angle as can be clearly seen in view of the inclination of the lowermost disc 75. When the arm 181 is pivoted about the rod 79. to remove the ledge 196 from beneath the lowermost disc 75, the upper surface 181' is moved in the direction of arrow F in FIGS. 4 and 5 so as to engage beneath the compact disc 75'. This holds the compact disc 75' in place until the compact disc 75 has dropped from the storage location into the carriage 70. When the am 181 returns to the position shown in FIGS. 4 and 5, the ledge dropped from the storage location into the carriage 70. When the arm 181 returns to the position shown in FIGS. 4 and 5, the ledge 196 is moved back to the position shown in FIGS. 4 and 5 and the upper surface 181' withdrawn from the cassette 75' so the cassette 75' can drop to the lower position where it will be caught by the ledge 196** and supported within the storage compartment.

Thus, when the stepping motor 171 is activated to move the carriage 70 into registry with one of the sections 74, such as to the position shown in FIG. 6, the carriage 70 is located below the required compact disc 75 which the purchaser wishes to buy. Once the carriage 70 is located in the correct position, the solenoid 111 is activated to extend the plunger 115 so that the finger 119 engages the portion 189 of the arm 181 to pivot the arm 181 on the rod 79 so the ledge 196 is removed from beneath the lowest compact disc 75 and the surface 181' engages the disc 75' above the lowermost disc 75 so the compact disc 75 drops from the position shown in FIG. 6 into the carriage 70 between the rail 105 and the front wall 95 of the carriage 70. The compact disc 75 rests on the floor 54 of the unit 14 between front wall 95 and rail 105.

The solenoid 111 then deactivates so that the plunger 117 is returned to its retracted position. A spring (not shown) may be included to retract the plunger 115 to ensure complete retraction of the plunger 115. This allows the arm 181 to return under the bias of the spring 187 so the ledge 196 moves back into the section 74 so as to catch the next compact disc 75' as the surface 181' is withdrawn from the disc 75' so the disc 75' falls to the lowermost position. The disc 75" falls to the position previously occupied by the disc 75'.

Figure 6:
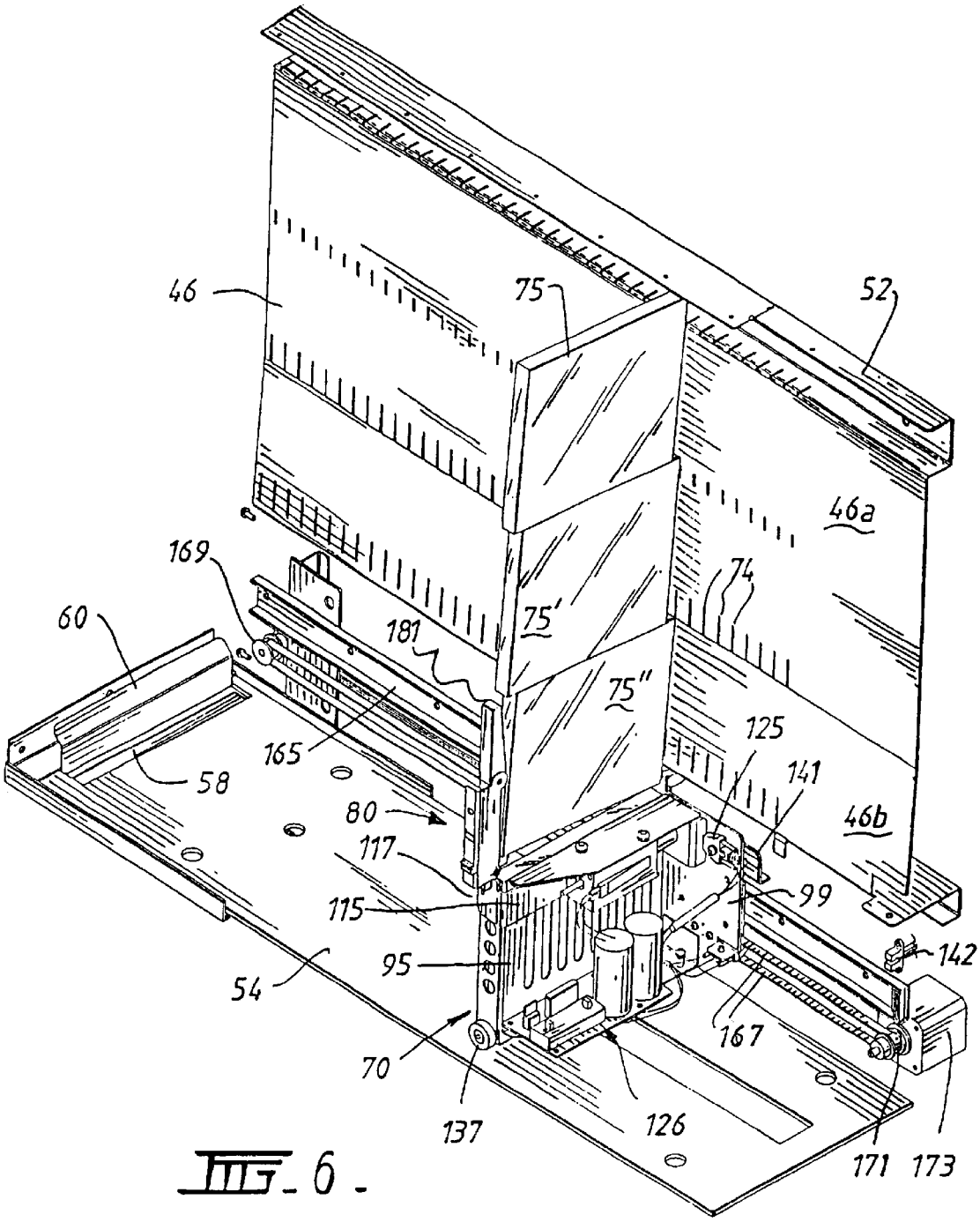
FIG. 6 is a partly broken away perspective view of the part of the vending unit shown in FIG. 3.

The sensor 137 detects that a compact disc 75 is properly loaded into the cartridge 70 as is shown in FIG. 8 and the stepping motor 173 is again activated to drive the carriage 70 from the position shown in FIG. 6 to the door 60. When the side walls 101 and 103 contact the door 60, they push the door 60 open against the bias of the return spring (not shown) to open the opening 58 so that as soon as the carriage 70 registers above the opening 53, the compact disc 75 will drop through the opening 58 to be collected from the dispensing outlet 59 shown in FIG. 1.

As the carriage 70 moves back and forward on floor 54 collecting and delivering cassettes to the opening 58, the sensor 127 will detect whether compact discs still remain in each of the sections 74 and output appropriate control signals so that the controller (to be described with reference to FIGS. 11 to 14) can determine whether compact discs still remain in the sections 74 or whether the storage compartment 46 requires refilling.

The position of the carriage 70 relative to the sections 74 can also be continuously monitored by the sensor 125 by the sensor 124 detecting bar codes or grids on housing section 159 which are arranged in registry with the sensor 124 so that the exact position of the carriage 70 can always be determined. Furthermore, when the carriage returns to the home position at the end of the vending unit (which is the right hand end in FIG. 3), the plate 141 will register between the portions of sensor 142 to indicate that the carriage 70 is at the home position. This also provides information to the controller for positioning the carriage 70.

FIG. 11 is a block diagram of a controller 200 of the preferred embodiment. The controller 200 comprises a power supply unit 201, a user interface module 202 and a vending unit 203. The modules 201 to 203 are interconnected. by a bus 205.

Figure 12:
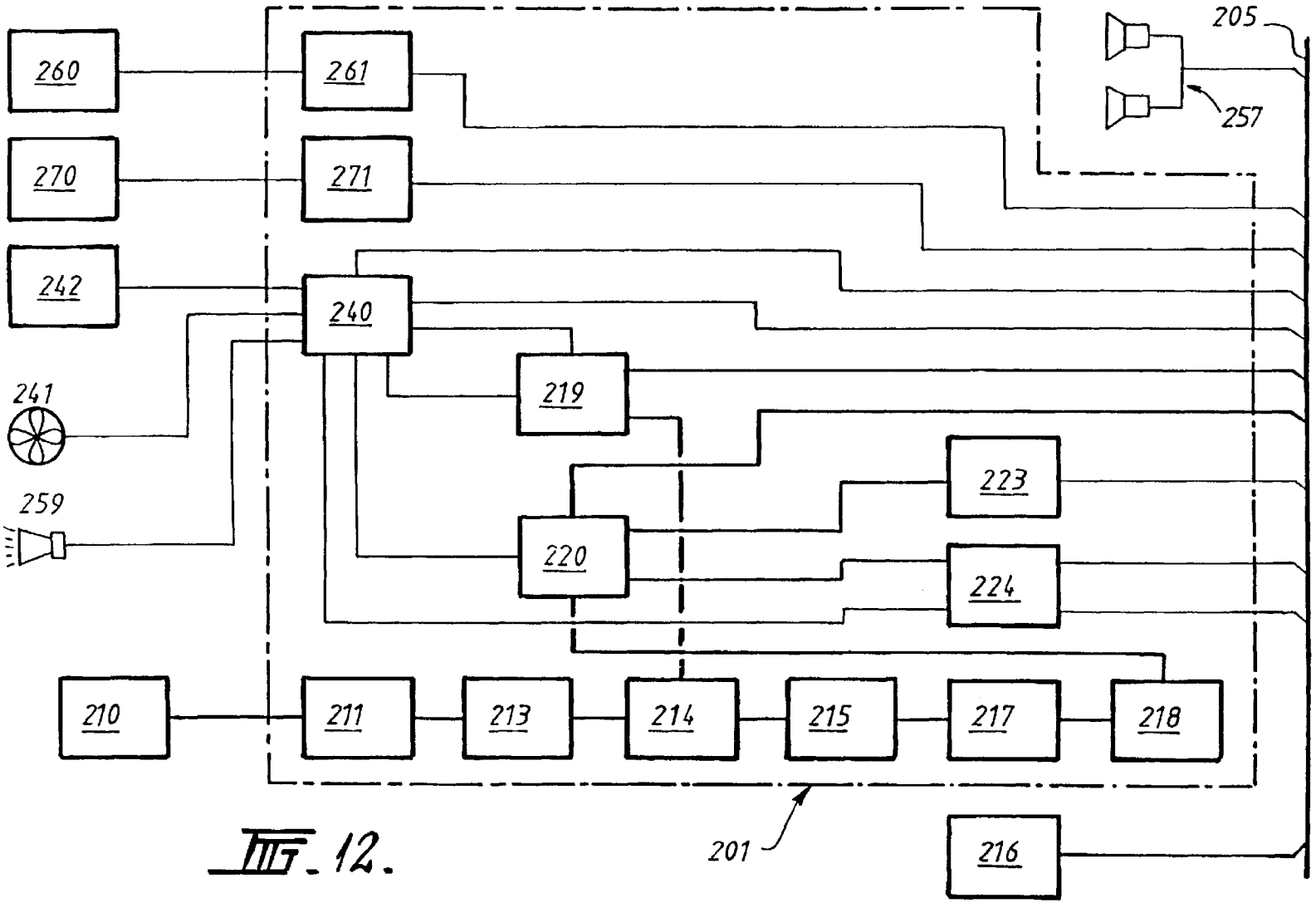
FIG. 12 is a detail showing power supply control system of FIG. 11.

The power supply control module 201 is more fully shown in. FIG. 12 and includes a conventional plug 210 for connection to mains power electricity. A surge protector 211 and circuit breaker 213 are provided. An earth leakage sensor 214 is also provided and an uninterruptable power supply unit 215 is also included. A further earth leakage sensor 217 and a circuit breaker 218 are also provided in the power supply. The earth leakage sensor 214 is connected to a power switch 219 and the circuit breaker 218 is connected to a second power switch 220 which are turned on and off by a control and alarm processing module 240. The switch 220 is connected to a supply 223 for providing 24 volt DC power and to a second supply 224 for providing 16 volt or 35 volt DC power.

The processing module 240 which performs alarm and processing and control functions and is coupled to the bus 205 and is powered by the second power supply 224. Module 240 receives information from the bus 205 and supplies output commands onto the bus 205. Security switches and sensors 242 are connected to the module 240 so that if the vending unit 10 is tampered with by someone trying to break open a door or the like, an alarm signal can be provided.

The bus 205 also connects to two telephone line networks 260 and 270 via transient barriers 261 and 271 so as to connect the vending machine 10 to a telephone network for EFTPOS or credit card checks and payments in a known way. The telephone connection also allows central networking for data gathering and software updates and the like. The alarm and processing module 240 is also connected to a fan 241 for cooling purposes. An alarm sounder unit 259 is also connected to the module 240 for sounding an audible alarm in the event that an alarm condition is detected by the module 240. The bus 205 is also connected to a light box 216 for providing light to illuminate advertising signs (not shown) which may be included on the housing 12. The bus 205 also connects to speakers 257 for playing samples of the discs which are stored on hard disc (not shown) which can be vended by the unit as the user goes through the purchase protocol which will be described in more detail hereinafter.

Figure 13:
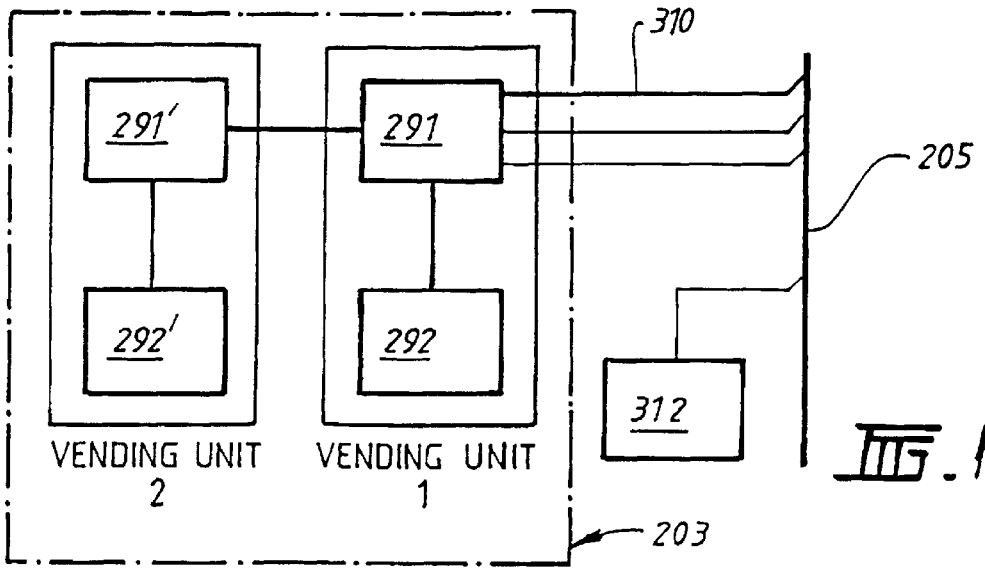
FIG. 13 is a block diagram of a vending unit module of FIG. 11.

FIG. 13 shows the vending module 203 which includes vending units 1 and 2 which are connected on bus 205 so that control signals can be received and forwarded to the alarm and processing module 240 and processor 340 (see FIG. 14) such as a PC for controlling the carriage 70 and also the solenoid 111 for enabling compact discs to be received from the storage compartment 46. The module 203 also provides signals to the stepping motor 173 for driving and controlling the stepping motor 173.

In FIG. 13, two vending units labelled vending unit 1 and vending unit 2 are shown. In the embodiment previously described, only one vending unit 46 is shown. However, if desired, two or more vending units identical to those described with reference to FIGS. 1 to 10 could be included in side by side relationship and controlled in master/slave fashion. In the embodiment shown in FIG. 13, the bus 205 is connected by bus 310 to a master control unit 291 which controls slave control unit 291' (and any other. slave control unit for additional vending units which may be included) which can then provide signals to carriage controllers 292, 292' etc to control the carriages 70. Thus, data from the sensors 124, 125, 127 and 137 so output signals can be supplied to the master controller 291 and also to the processor and alarm module 240 for processing. Appropriate commands supplied on the bus 310 to the master controller 291 and then to the controller 292 control both the stepping motor 173 and the plunger 115 to position the carriage 70 in the required place and open a storage section 74 to receive a compact disc and then to move the carriage 70 to the opening 58 for supplying the compact disc to the purchaser. Data supplied from the carriage 70 also includes data relating to whether compact discs are still remaining in any of the sections 74 so that the vending machine can be refilled when required.

Figure 14:
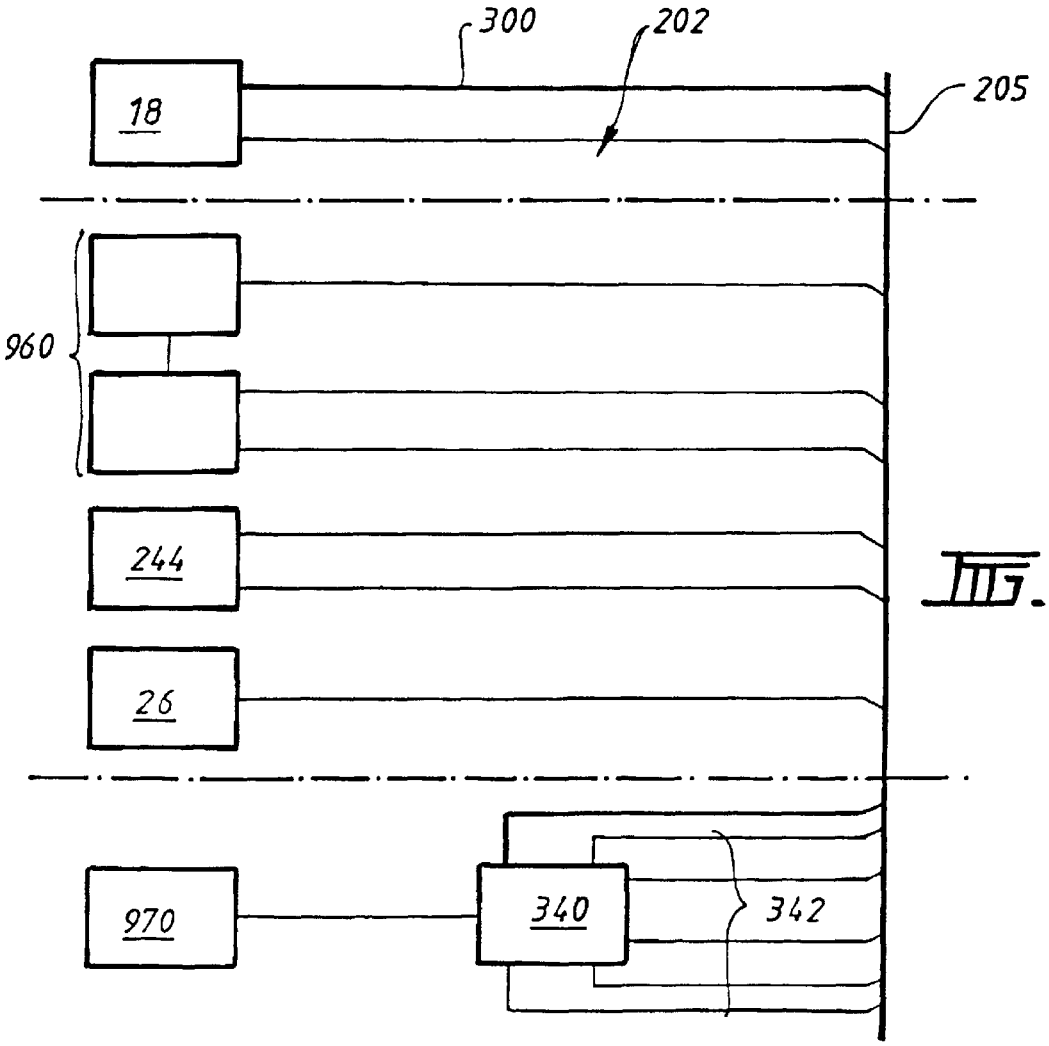
FIG. 14 is a block diagram of FIG. 11.

FIG. 14 shows the user interface module 202 which includes the monitor 18 which has the touch screen for input of commands which is connected to bus 205 by line 330. The PC 340 is also connected to the bus 205 by lines 342 for receipt of data and manipulation and processing of data within the PC 340. A printer 244 and pin pad 26 are also coupled to the bus 205. Bus 205 is also connected to a pin pad and terminal 960 which are coupled to the telephone line networks 260 and 270 for transmission of data relating to the financial transaction to enable payment for the compact discs. A wireless keyboard sensor 970 may also be coupled to the processor 340 for receiving infrared controls from a maintenance person in order to perform maintenance on the vending unit 10.

Figure 15:
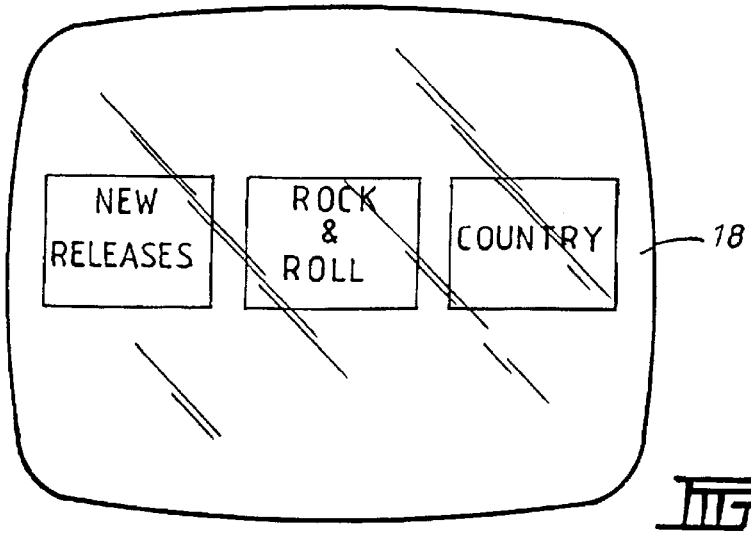
FIG. 15 is a view showing display on a screen of the vending unit for facilitating purchase o articles.
Figure 16:
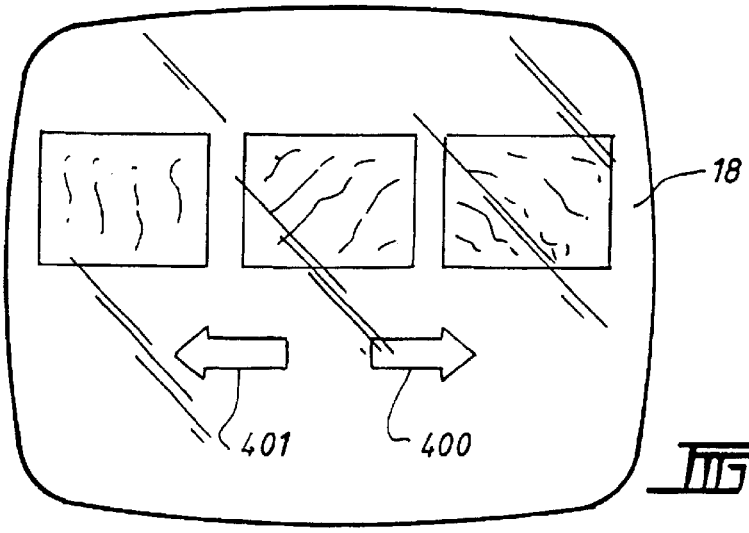
FIG. 16 is a view of a further display.
Figure 17:
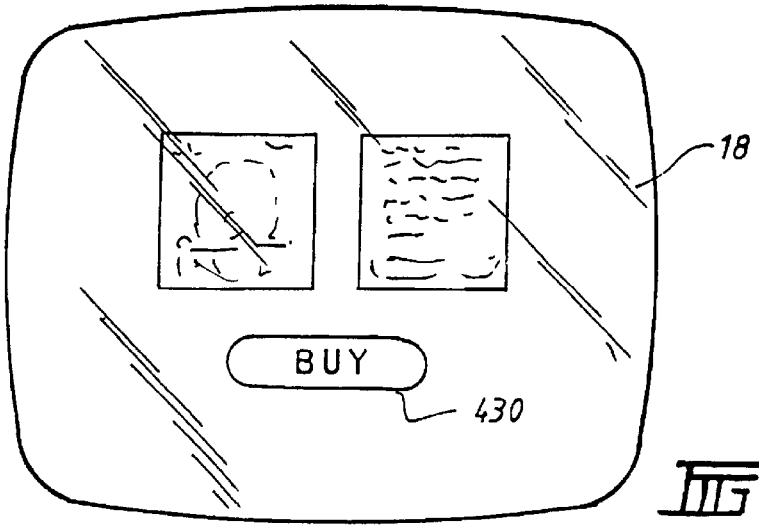
FIG. 17 is a view of yet a further display.

FIGS. 15 to 17 show the protocol for purchasing a compact disc from the vending machine 10. When a purchaser approaches the machine 10, the purchaser need only touch the monitor touch screen 26 in order to activate the vending machine 10. When the touch screen 18 is touched on any part of the screen, an initial menu is displayed which may give choices for compact disc selection such as shown in FIG. 15 which comprise new releases, rock and roll compact discs, country and western compact discs or the like. The purchaser will make a choice, for example, new releases by merely touching the new release display on the touch screen 26. This will bring up a new menu as shown in FIG. 16 which will show all of the compact discs stored within the vending machine under that heading. For example, three compact discs can be displayed at any one time and if the user wishes to scroll through all of the compact discs available the arrows 400 and 401 shown in FIG. 16 can be touched to cause the monitor 18 to display additional titles which can be purchased.

When the user has made up his or her mind as to which compact disc is to be purchased, the image of that compact disc on the touch screen 26 is touched. This causes a new display such as that shown in FIG. 17 to be displayed which shows the front-and back cover of that compact disc and also includes a buy indicator 430 on the touch screen 26.

Once, the user is satisfied that that is compact disc required, the user can touch the buy symbol which will then change to a pay flashing signal. At the same time, the processor 340 can output audio data on line 342 to bus 205 for playing a sample of the compact disc through the speakers 257 shown in FIG. 12.

User then makes payment by inserting his or her credit card or EFTPOS card into the slot 22 so that it can be read by the terminal 260 and the appropriate financial data transmitted to the bank or credit facility over the telephone lines via the telephone networks 260 or 270 in a manner which is known and conventional for normal EFTPOS purchases or credit authority. Once the appropriate acknowledgment of payment or credit is received back by the terminal 260, appropriate signals are outputted onto the bus 205 to activate the carriage 70 to cause the carriage 70 to move to the appropriate storage location in which the selected compact disc resides so that the compact disc can be loaded into the carriage 70 in the manner described above and transported to the opening 58 whereupon the compact disc drops through the opening 58 for collection by the purchaser from the outlet 59 on the front of the vending machine 10.

A receipt will be printed by the printer 244 and outputted through slot 24 to the purchaser.

Data relating to the location of the various compact discs in the sections 74 is stored in the processor 340 so that when the appropriate compact disc is selected, the processor 340 can output the required storage section information to the vending module 203 to cause the vending module 203 to drive the carriage 70 to the correct location for collection of the compact disc and delivery of the compact disc to the outlet opening 58.

A second embodiment of the invention is described with reference to FIGS. 18 to 23. This embodiment is the same as the embodiment previously described except that the manner of dispensing articles from the carriage 70 is different. This embodiment also uses a linear motor rather than a stepping motor in order to drive the carriage (so increased power can be delivered if necessary) and includes a slight modification to the control system.

Figure 18:
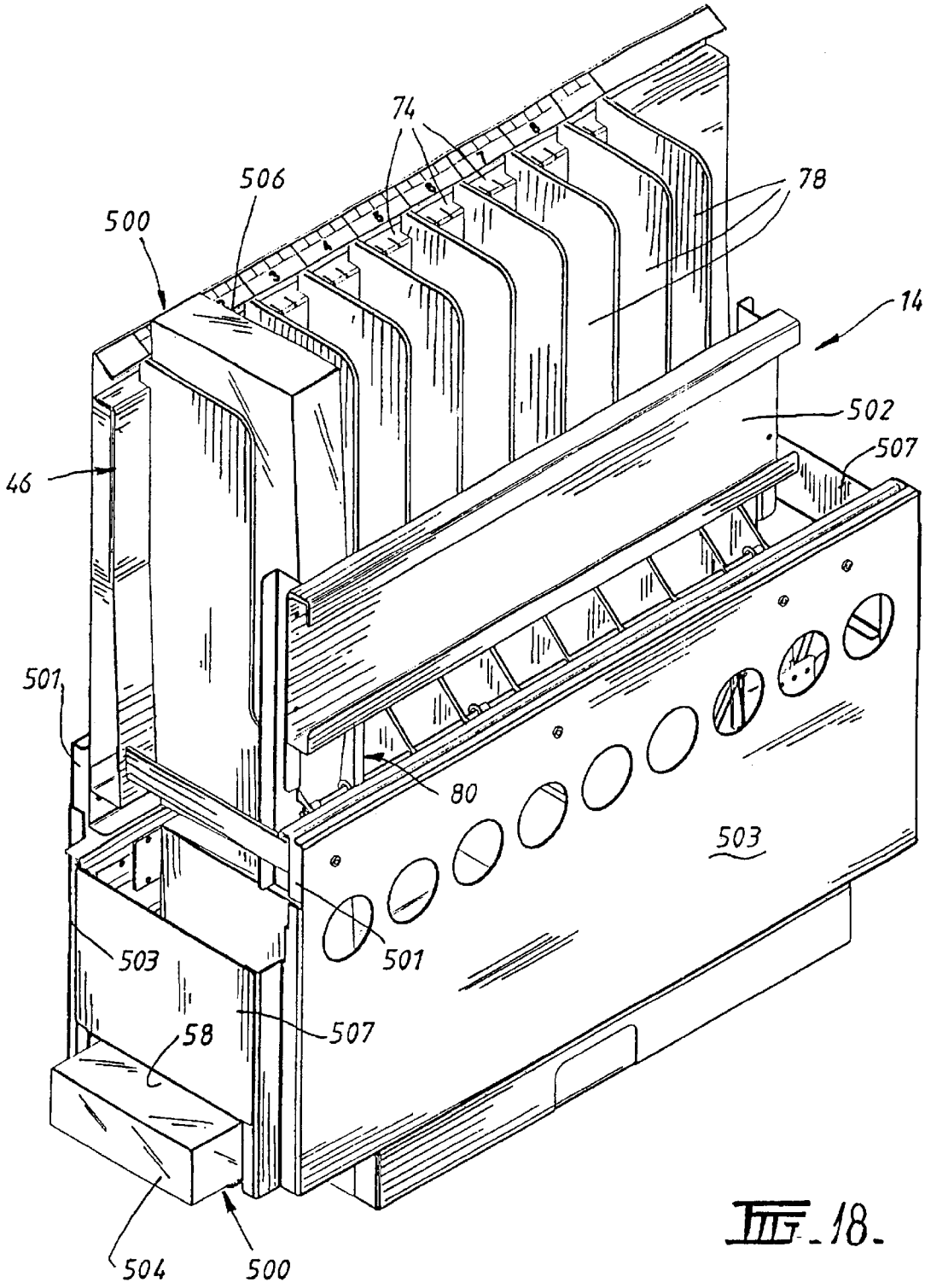
FIG. 18 is a perspective view of a vending unit according to a second embodiment of the invention.

FIG. 18 is a front perspective view of a vending unit 14 according to the second embodiment. Like parts designate similar components to those described with reference to FIGS. 1 to 17. In this embodiment the sections 74 are slightly larger to accommodate boxes. (having a bottom 504 and a front face 506) which are somewhat bigger than the compact disc 75 described in the previous embodiment. The boxes are shown by reference numeral 500 and may be packaged with a single article or various loose articles such as merchandise associated with movies, entertainment groups or the like. The boxes 500 are dispensed from the compartment 75 by movement of latches 80 (not shown in FIG. 18) which. are identical to those described in the embodiment of FIG. 1.

The vending unit 14 has side rails 501 which enables the storage compartment 46 to slide in and out of the machine 10 (shown in FIG. 1) in generally the same manner as the vending unit described with reference to the embodiment of FIG. 1. A side door 502 is provided which can swing downwardly into an open position to gain access to the compartment 48 (shown in FIG. 18) provided in the unit 14. Fixed side walls 503 are provided below the door 502 as are end walls 307. Outlet opening 58 in this embodiment is provided on a front end of the vending unit rather than the floor of the vending unit and the outlet 59 (see FIG. 1) of the machine 10 is aligned with the opening 58 in the unit 14.

Figure 19:
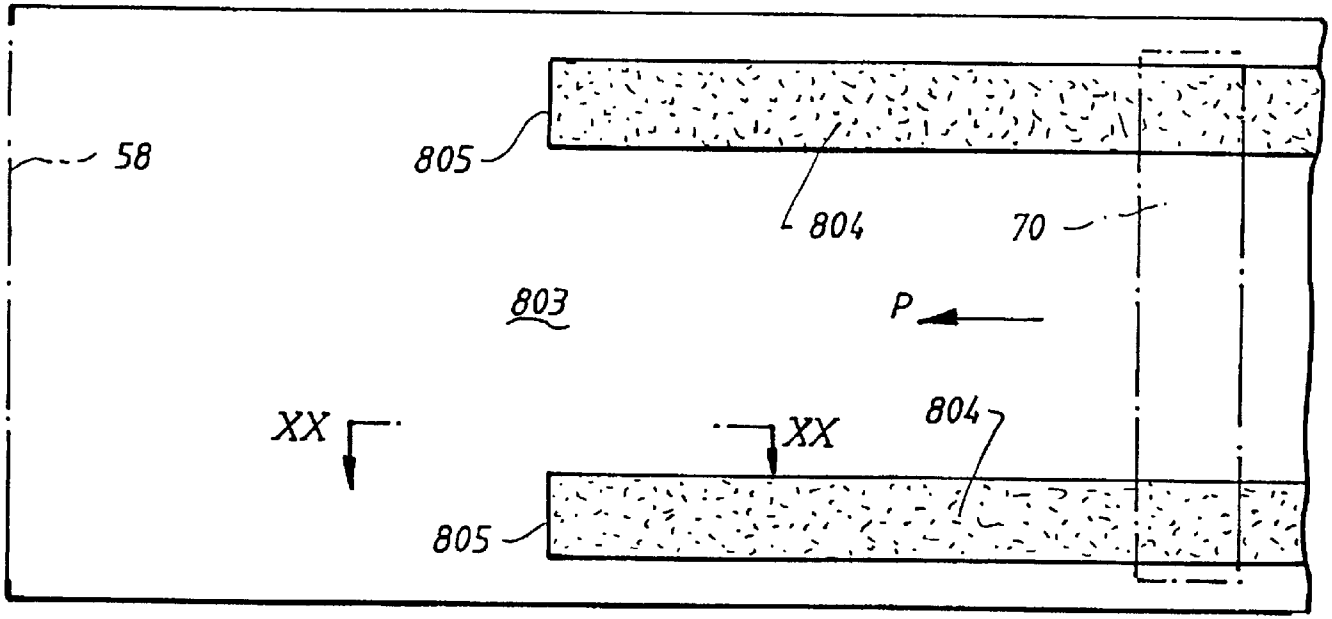
FIG. 19 is a plan view of the floor of a dispensing unit according to the embodiment of FIG. 18.
Figure 20:
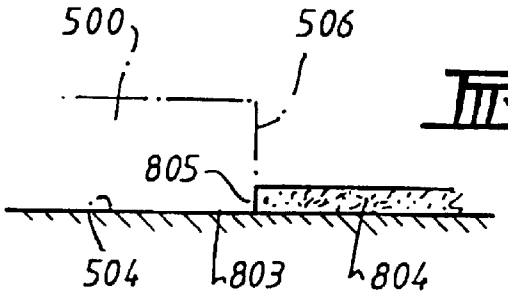
FIG. 20 is a view along the line XX—XX of FIG. 19.

FIG. 19 is a plan view of the floor of the vending unit 14 of FIG. 18. The floor includes a generally flat base 803 upon which are adhered two plastic strips 804. The strips 804 terminate slightly short of the outlet opening 58 and have end edges 805. As shown in FIG. 20 the end edges 805 define abutments. As explained in the embodiment of FIGS. 1 to 18 the carriage 70 has an open bottom and when moved in the direction of arrow P in FIG. 19 the carriage 70 will move over the edges 805 of the strips 804. The article 500 (shown in FIG. 20 in dotted lines) will move in front of the abutments formed by edges 805 and drop down in the carriage onto the base 803 so as to sit in front of the edges 805 formed by the ends of the strips 804. The distance from the edges 805 and the outlet opening 58 should be greater than the width of the articles 500.

The articles are dispensed from the sections 75 into the carriage 70 in the same manner as described with reference to the embodiment of FIG. 1. The embodiment of FIG. 18 also includes all the sensors described with reference to FIG. 1 for sensing movement of the carriage 70 and also movement of the articles 500.

Figure 21:
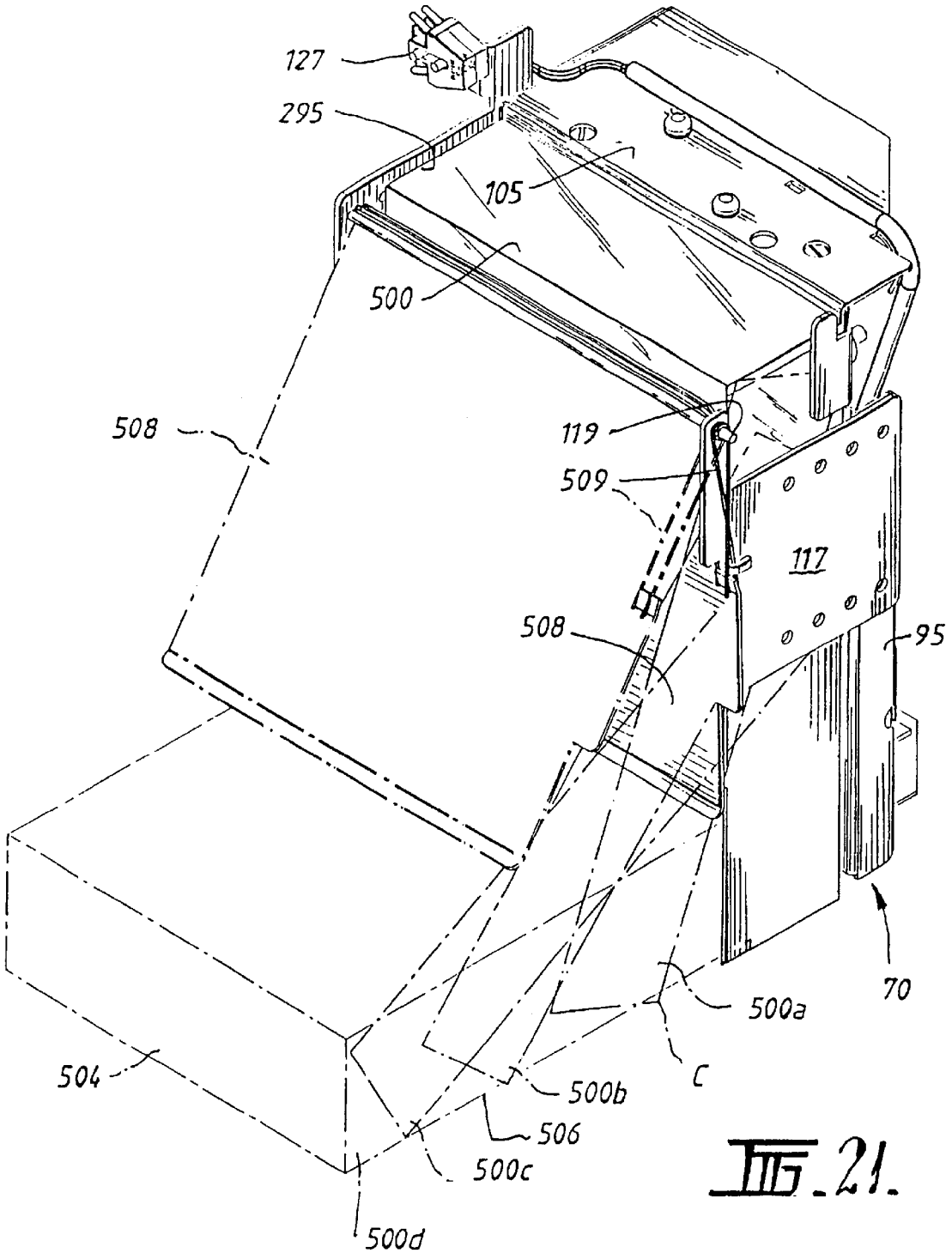
FIG. 21 is a front perspective view of a carriage used in the embodiment of FIGS. 18.
Figure 22:
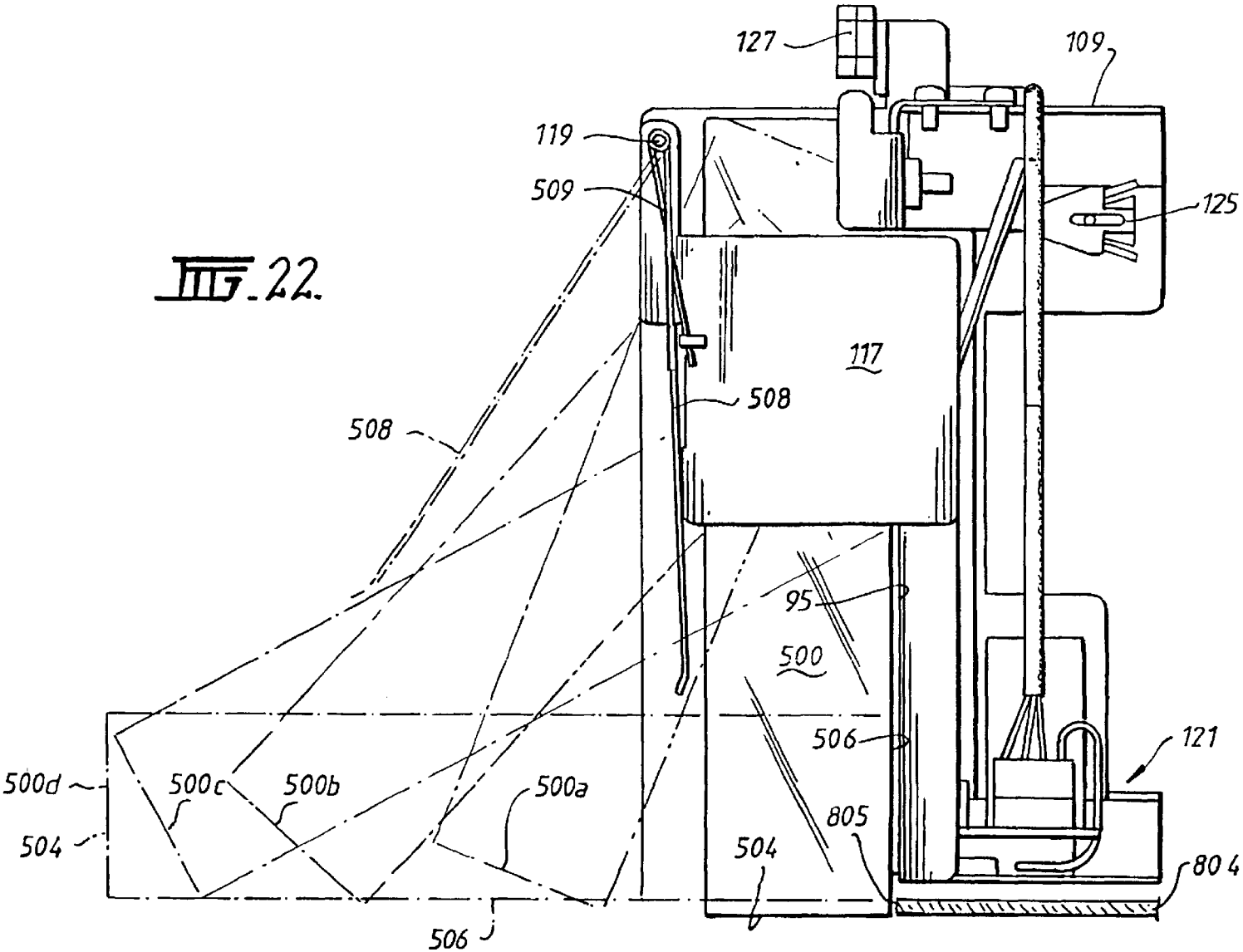
FIG. 22 is a side view of the carriage of FIG. 21.

The carriage 70 of this embodiment is shown in FIGS. 21 and 22. The carriage is similar to that of the previous embodiment except that it is designed to receive articles 500 therefore the top opening 95 is slightly wider.

In this embodiment the rod 119 pivotally mounts a flap 507 which is biased to a closed position (i.e. a vertical position) by a spring 509. The carriage in this embodiment may or may not include a wheel 137 as described with reference to the embodiment of FIG. 1.

When the carriage is moved towards the outlet opening 58 and over the edges 805 of the strips 804 the article 500 will drop down onto the base 803 as previously described. The carriage 70 is then moved in the reverse direction by the linear motor used to drive the carriage back and forth along the floor of the vending unit. Because the article 500 will engage behind the edge 805 formed by the ends of the strips 804 backward movement of the carriage 70 will cause the article 500 to tip onto its front face 506 as shown in FIGS. 21 and 22. The tilting movement of the article 50 as it moves from the vertical position to a generally horizontal position will push the flap 507 open thereby enabling the article 500 to release from the carriage as the carriage moves backwards away from the opening 58. The carriage 70 moves a sufficient distance to enable the article 500 to drop from the vertical position to the horizontal position as shown by the reference numerals 500*a*, 500*b*, 500*c* and 500*d* in FIGS. 21 and 22 which show sequentially how the article 500 moves during backward movement of the carriage 70. The sequential movement shown by reference numerals 500*a* to 500*d* is illustrative only. It should be noted that the comer C of article 500 in FIG. 21 remains substantially in the same position when the carriage 70 is moved backwards with article 500 pivoting downwardly from the vertical position to the horizontal position generally about the comer C which is engaged behind the edge 805. The flap 507 controls movement of the article 500 and generally guides the movement from the vertical position to the horizontal position to ensure that the article 500 is properly delivered into the horizontal position. In this regard, the door 507 supplies a slightly downward pressure on the article 500 as the flap 507 is pushed open thereby assisting in the controlled movement of the article 500 from the vertical position to the horizontal position. As the article 500 drops to the fully horizontal position the flap 507 can close under the influence of the spring 509. When the article 500 is completely released from the carriage in the above mentioned manner the carriage again moves forward towards the opening 58 so that the back wall 95 of the carriage 70 will push the article 500 forward and through the outlet opening 58 to position shown in FIG. 18 so the article can simply be removed by the purchaser.

Figure 23:
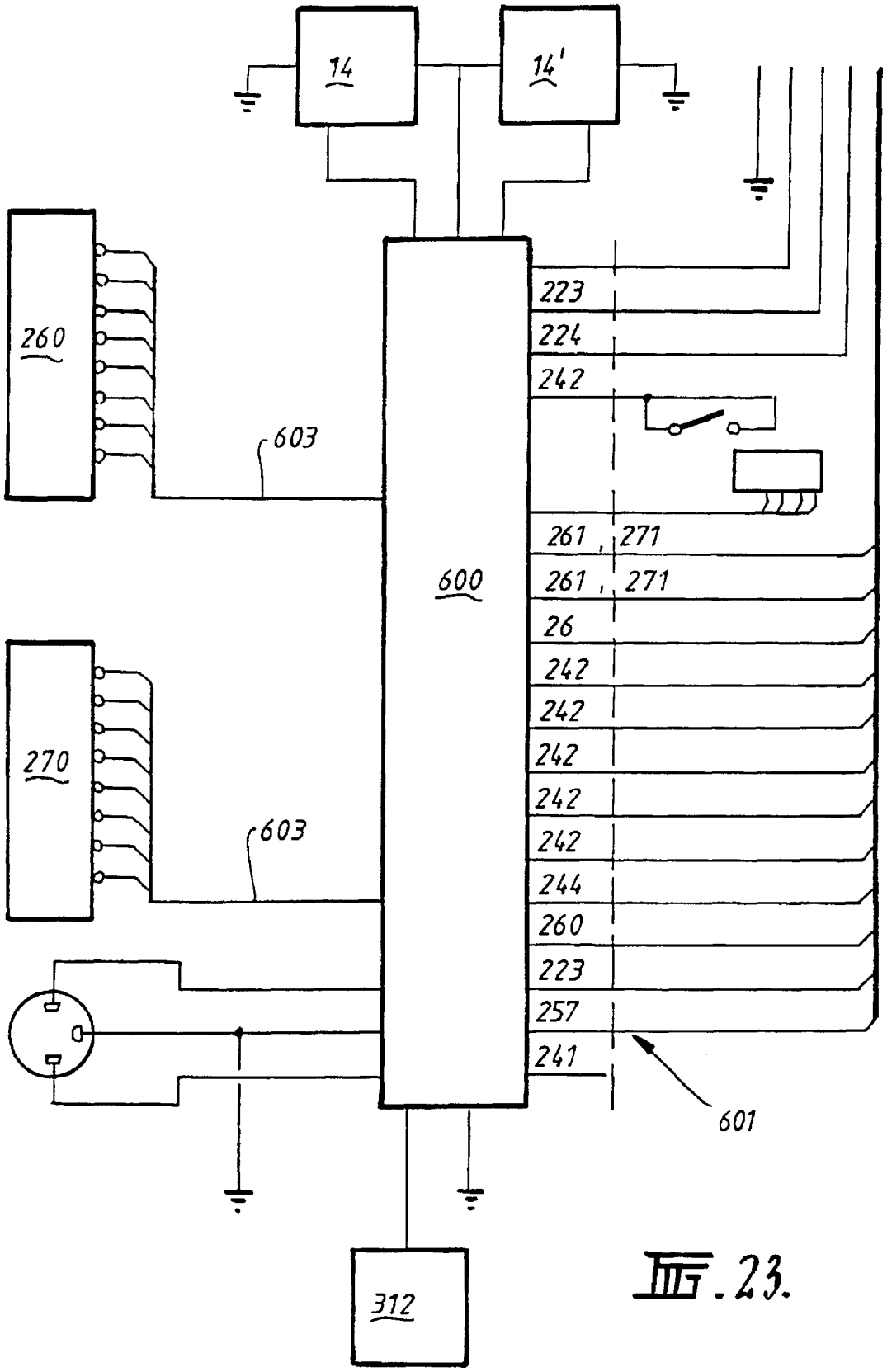
FIG. 23 is a block circuit diagram applicable to the embodiment of FIG. 18.

Movement of the carriage 70 to dispense the article through the outlet opening 58 is under the control of controller 600 shown in FIG. 23. The controller, as in the previous embodiment, controls all operation of the machine 10 including the vending unit 14 and linear motor which will drive the carriage 14 backward and forward along the vending unit 14 in the manner described with reference to FIG. 1. In this embodiment, as is clear from the above description, when the carriage 70 initially receives the article and moves towards the outlet opening 58 so as to deposit the article 500 in front of the edge 805, the controller controls the carriage 14 to move backwards to tilt the article as described and shown in FIGS. 21 and 22 so the article tips from a vertical position to a generally horizontal position and is removed from the carriage 70 and then the carriage 70 is again moved forward to push forward the article out through the opening 58.

With reference to FIG. 23 the vending unit 203 used in the embodiment of 18 is shown in FIG. 23 and includes all of the functions described with reference to FIG. 11 and FIG. 12. In this embodiment a central microprocessor 600 controls each vending unit 14, 14' (if there is more than one vending unit) and so on. The microprocessor 600 receives data and outputs data on lines 601 and telephone lines 603 in same manner as previously described. Lines 601 effectively form the bus 205 shown in FIG. 23 and once again like reference numerals in FIG. 23 correspond to those with reference to FIGS. 11 and 12.

In this embodiment of the invention, the carriage 70 in the vending unit 14 may include additional sensors for controlling the reverse movement of the carriage 70 so as to tip the articles 500 onto their front face 506 and also to control and monitor movement of the carriage 70 as it pushes the articles 500 out through the outlet opening 58.

Figure 26:
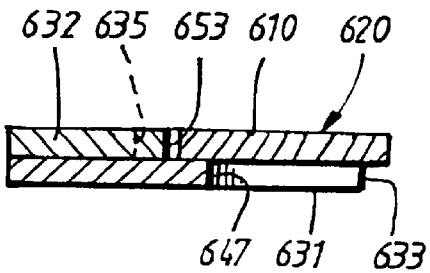
FIG. 26 is a cross-sectional view along the line XXVI—XXVI of FIG. 24.
Figure 24:
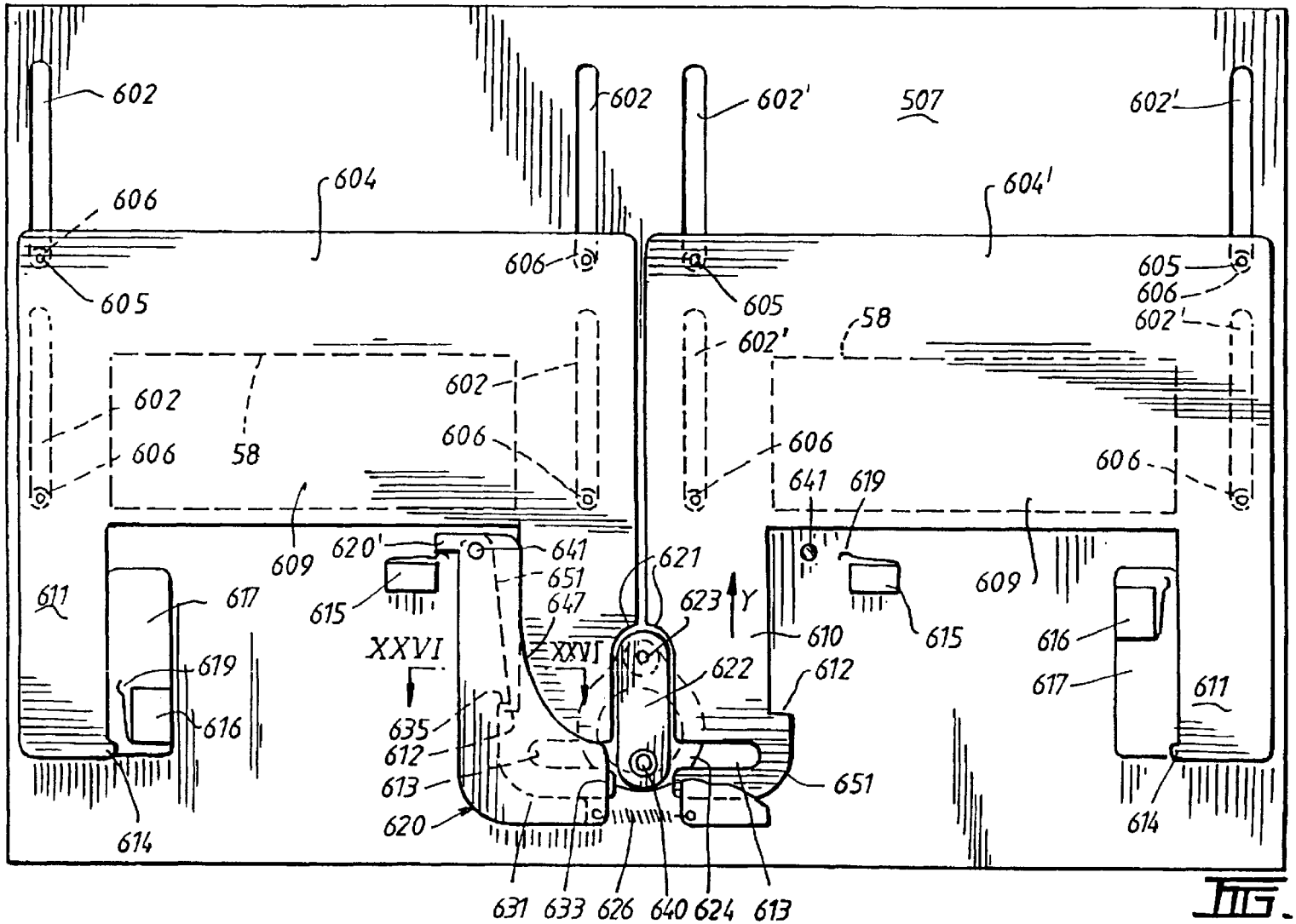
FIG. 24 is a front view of a gate mechanism used in the second embodiment of the invention.
Figure 25:
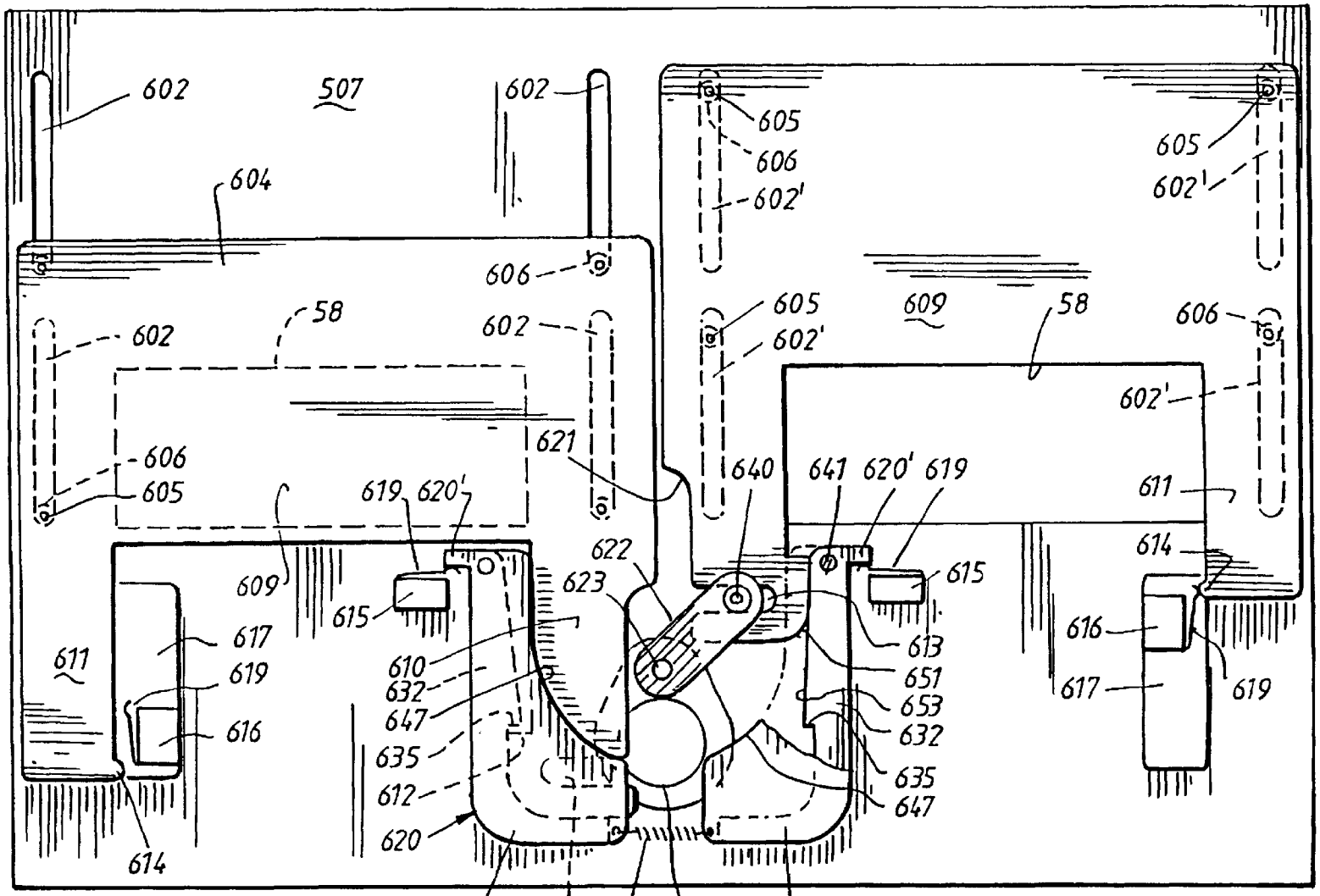
FIG. 25 is a view similar to FIG. 24 showing additional detail.

FIGS. 24 to 26 show a gate mechanism used for closing and selectively opening the outlet opening 58 to enable articles to be dispensed through the outlet opening 58. The gate mechanism is arranged between the front cover of the machine as shown in FIG. 1 and the vending unit 14. The gate mechanism has a rear plate 507 which may be the front wall 507 of the vending unit shown in FIG. 18. In the arrangement shown in FIG. 24, the gate mechanism is a dual gate intended to operate with two side-by-side vending units for dispensing articles through corresponding outlet openings 58. However, if desired, only one gate could be employed if only one vending unit is used.

The plate 507 is provided with four slots 601, 601 and 602, 602. A first vertically moving gate 603 is arranged for sliding movement along the slots 601 and a second vertically moving gate 604 is arranged for sliding movement along the slots 602. Rollers 605 (see FIG.25) may be arranged on axles 606 for guiding movement of the gate 603 and 604 in the respective slots 601 and 602.

Each of the gates 603 and 604 are effectively a mirror image of one another and the gates 604 has a main panel portion 609 which closes the outlets 58, a first depending leg 610 and a second depending leg 611. The first leg 610 is provided with a ledge 612 and a slot 613. The second leg 611 is provided with a button 614 at its lower end.

First sensor switches 615 are provided for detecting release and re-locking of the gates 603 and 604 and second sensor switches 616 are provided for determining when the gate 616 is in the fully opened position. The switches 616 can be mounted in four different positions on mounts 617 at different heights so as to sense when the gates 603 and 604 are at a fully open position. The different heights correspond to different widths of articles which are to be dispensed so that the gate only opens the distance necessary to dispense the required article through the outlet 58. If the article is a compact disc, the gate 604 need only open outlet opening 58 for, say, a third of the height of the opening 58. If a larger article is to be dispensed, the sensor 616 can be positioned so as to detect when the gate opens to a greater extent to expose more of the outlet opening 58 so the article can be dispensed with the outlet opening 58.

The sensors 615 and 616 have reed switches 619 which are opened and closed to operate the sensors 615 and 616.as will be described in more detail hereinafter.

A pair of latches 620 are pivotally mounted to the face 507. Only one of the latches is shown in FIG. 24, the other being a mirror image and being removed to show the detail of leg 610. The latches 620 have a shoulder 621 which abuts the reed switch 619 on the sensors 615.

The legs 610 also have an arcuate cutout 621 which accommodates a lever 622. The lever 622 is pivotally mounted on a pivot pin 623 and is driven by a motor 624 (see FIG. 25) as will be described hereinafter. The latches 620 are coupled together by a spring 626 so they are biased into the closed position shown in FIG. 24. As is best shown in FIGS. 25 and 26, the latches 620 have a front panel 631 and a rear panel 632 which is integral with or fixed onto the front panel 631. The front panel 631 has an end 633 and the rear panel 632 is provided with a step or ledge 635.

The lever 623 carries a projecting stud 640 and the latches 620 are pivoted to the face 605 on pivot pins 641.

When it is desired to dispense an article through the outlets 58, the carriage moves the article as described above. The controller described with reference to FIG. 23 also controls operation of the gates 603 and 604 to open the outlets 58 to enable the article to be dispensed. The controller operates the motor 624 to swing the lever 622 to the right or to the left in FIG. 24 to open one of the gates 603 or 604. Initial movement of the lever 622 to, for example, the right in FIG. 24 will cause the lever 623 to initially abut the end edge 633 of the latch 620. This will pivot the latch 620 against the bias of the spring 626 so that the ledge 635 is removed from the ledge 612 of the legs 610 to thereby release the leg 610 and the gate 604. Continued pivotal movement of the lever 622 will drive the stud 640 into the slot 630 so as to lift the gate 604 vertically with the rollers 605 rolling and being guided in guide slots 602. FIG. 25 shows the gate 604 lifted to its full extent to open the outlet-opening 58. As the lever pushes the latch 620, the latch is pivoted around pivot point 641 which will raise shoulder 621 upwardly. away from reed switch 619 so that the switch 615 can detect release of the arm 610. As the gate is pushed upwardly in the direction of arrow Y in FIG. 24 to the fully open position shown in FIG. 25, the button 614 will contact the reed 619 of the switch 616 to provide an indication that the gate is at the required fully open position. The motor 624 will then stop so that the article can be released through the outlet. opening 58. A sensor (not shown) may be provided to determine when the purchaser withdraws the article 500 from the outlet opening so that a signal can be provided to the controller shown in FIG. 23 to close the gate 604.

After release of the article through the outlet opening 58, the gate 604 can be closed by reversing the direction of the motor 624 so that the lever 622 swings back to the position shown in FIG. 24. As the lever swings back to the position shown in FIG. 24, the arcuate edge 651 of leg 610 will ride on the edge 653 of panel 632 of the latch 620 and push the latch slightly open so as to enable the shoulder 612 to seat below the shoulder 635 on the latch to again lock the legs 610 and therefore the gate 604 in the closed position. The pivoting movement of the latch 620 will again operate the switch 615 in the same manner as described above so as to indicate that the latch 620 has re-locked the leg 610 in position to close the outlet opening 58.

Thus, the outlet opening 58 is secured so that articles cannot be pushed into the outlet opening 58 with a view to vandalising the machine or an attempt cannot be made to steal articles from the machine by reaching through the outlet opening 58.

Apart from dispensing compact discs and boxes, the vending machine 10 could also perform ancillary functions such as issuing of movie tickets or the like by appropriate inputs from a user in response to commands shown on the touch screen 26 so that the user can pay for and receive a printed movie ticket from the machine for use at a movie house in which the vending machine may be located. Since modifications within the spirit and scope of the invention may readily be effected by persons skilled within the art, it is to be understood that this invention is not limited to the particular embodiments described by way of example hereinabove.

The claims defining the invention are as follows:

1. A vending machine for vending articles, including:

user input means for allowing a user to input information relating to purchase of one of the articles;

payment receiving means for receiving payment relating to purchase of the article;

a vending unit for storing the articles and for dispensing the articles to a purchaser;

control means coupled to the vending unit, the user input means and the payment receiving means for receiving data from the user input means concerning the article to be purchased, determining that payment has been made and for causing the vending unit to dispense the article; and wherein the vending unit includes:

a plurality of storage sections each for storing articles, the storage sections having engaging means for contacting the articles and causing the articles in each section to be stacked one above the other with a bottom portion of the article stacked above a lowermost of the articles being exposed by extending beyond the lowermost of the articles;

a carriage movable relative to the storage sections;

moving means for moving the carriage to align the carriage with a particular one of the articles stored in the storage section;

a latch associated with each of the plurality of storage sections, each latch having an engaging portion for engaging a lowermost one of the articles stacked in each plurality of storage sections and for holding the articles, and each latch having a retaining portion so that when the latch is moved to withdraw the engaging portion from the lowermost article to release the lowermost article, the retaining portion is moved concurrently into engagement with the exposed bottom portion of the article above the lowermost article to hold the article above the lowermost article and any articles above that article so that only the lowermost article is dispensed from the respective storage section, and upon return of the latch the retaining portion disengages from the exposed bottom portion so that the articles can drop under the influence of gravity and be held by the engaging portion within the storage section.

2. The machine of claim 1, wherein the latch is a pivotally mounted latch for holding the aligned articles in each section.

3. The machine of claim 1, wherein the carriage is mounted for movement below the sections and includes a plunger for contacting the latch and for moving the latch to release the lowermost article so the article can drop into the carriage for transportation to the dispensing station.

4. The machine of claim 3, wherein the plunger includes a solenoid for moving the plunger from a retracted position to an extended position so that in the extended position the plunger engages the latch and pivots the latch out of engagement with the article to enable the article to drop into the carriage.

5. The machine of claim 1, wherein the carriage is coupled to an endless belt and the belt is driven by a stepping motor to drive the carriage beneath one of the storage sections into registry with a particular one of the articles stored in that storage section.

6. The machine of any one of claim 1, wherein the carriage includes a wheel for facilitating movement of the carriage.

7. The machine of claim 1, wherein the carriage includes:

a sensor for determining the position of the carriage beneath one of the storage sections;

a sensor for detecting when the carriage is in a home position;

a sensor for determining whether an article is within the carriage; and a sensor for determining whether articles are stored in the storage sections.

8. The machine according to claim 1, wherein the engaging portion includes a ledge which locates below the lowermost article to retain the articles in each section and the retaining portion comprises an uppermost surface of the latch.

9. The machine of claim 8, wherein the latch is pivotally mounted on a pivot between the ledge and the uppermost surface so that when the ledge is in engagement with the lowermost article, the uppermost surface is outwardly of the lowermost article so as not to interfere with the articles stacked in each section and when the latch is pivotally moved to withdraw the ledge from the lowermost article, the upper surface is moved into alignment with the articles to engage the article above the lowermost article to retain the article above the lowermost article and any article above that article within the respective storage section.

10. The machine according to claim 1, wherein the articles in each section are stacked in an inclined staggered manner so that the exposed bottom portion of each article projects outwardly towards the latch so that when the latch moves to release the lowermost article the retaining portion is able to engage the exposed bottom portion edge of the article immediately above the lowermost article to hold that article within the respective storage section.

11. The machine according to claim 1 wherein the engaging means comprises a first substantially vertical wall portion and a second wall portion inclined with respect to the vertical wall portion and located below the vertical wall portion.

12. A vending machine for vending articles, the articles each having a bottom and a front face, including:

user input means for allowing a user to input information relating to purchase of one of the articles;

payment receiving means for receiving payment relating to purchase of the article;

a vending unit for storing the articles and for dispensing the articles to a purchaser;

control means coupled to the vending unit, the user input means and the payment receiving means for receiving data from the user input means concerning the article to be purchased, determining that payment has been made and for causing the vending unit to dispense the article; and wherein the vending unit includes:

a storage compartment for storing a plurality of the articles with the bottom being substantially horizontal and the front face being substantially vertical;

a carriage mounted below the storage compartment and movable relative to the storage compartment, the carriage having an open bottom;

a floor below the open bottom of the carriage;

an outlet opening;

releasing means for releasing one of the articles from the storage compartment and to the carriage;

moving means for moving the carriage to align the carriage with a particular one of the articles stored in the storage compartment and, after receipt of the article in the carriage, toward the outlet opening;

an abutment adjacent the floor so that when the carriage moves the article over the abutment the article drops in front of the abutment, the moving means being for reversing movement of the carriage so that the article is drawn backwards and is tipped, by the backward movement of the carriage and engagement of the article with the abutment, onto the front face of the article to remove the article from the carriage; and dispensing means for dispensing the article out of the vending unit through the opening.

13. The machine of claim 12, wherein the storage compartment includes a plurality of sections, each section being for storing a plurality of articles in a stacked manner one above another.

14. The machine of claim 12, wherein the releasing means comprises a pivotally mounted latch associated with each section for holding the articles in each section.

15. The machine of claim 14, wherein the carriage includes a plunger for contacting the latch and moving the latch to release the article so the article can drop into the carriage for transportation to the outlet opening.

16. The machine of claim 15, wherein the plunger includes a solenoid for moving the plunger from a retracted position to an extended position so that in the extended position the plunger engages the latch and pivots the latch out of engagement with the article to enable the article to drop into the carriage.

17. The machine of claim 12, wherein the carriage is coupled to an endless belt and the belt is driven by a motor to drive the carriage beneath the storage compartment into registry with a particular one of the articles stored in the storage compartment.

18. The machine of claim 12, wherein the carriage includes a wheel for facilitating movement of the carriage.

19. The machine of claim 12, wherein the carriage includes:

a sensor for determining the position of the carriage beneath the storage compartment, a sensor for detecting when the carriage is in a home position;

a sensor for determining whether an article is within the carriage; and a sensor for determining whether articles are stored in the storage compartment.

20. The machine of claim 19, wherein the sensors are optical sensors.

21. The machine of claim 12, wherein the user input means comprises a touch screen which displays information so that the user can input commands by touching the screen in response to the information displayed on the screen.

22. The machine of claim 12, wherein the payment receiving means comprises a card reader for receiving a financial transaction card such as a credit card or EFTPOS card or smart card for enabling payment in respect of the article.

23. The machine of claim 12 wherein the dispensing means comprises the carriage which, after the article is removed from the carriage during backward movement of the carriage, is moved towards the opening by the moving means to push the tipped article through the opening.

24. The machine of claim 12 wherein the floor has a plurality of strips and the abutment is formed by an end of the strips spaced from the outlet opening so that when the carriage is moved towards the outlet opening the bottom of the article slides on the strips and then drops over the end of the strips as the carriage passes over the abutment formed by ends of the strips.

25. The machine of claim 12 wherein the carriage has a front flap movable from a closed position to an open position as the carriage moves backwards, to enable the article to be removed from the carriage as the article is tipped by the abutment during backward movement of the carriage.

26. The machine of claim 12 wherein a vertically slidable gate is provided for selectively opening and closing the outlet opening.

27. The machine of claim 26 wherein the gate has a main body panel and a pair of leg members, one of the leg members having a slot and a shoulder, a latch pivotally mounted for engaging the shoulder of the leg to secure the gate in a closed position, a lever pivotally mounted for movement to engage the slot and release the latch from the shoulder to enable the gate to be moved by the lever vertically from a closed position to an open position to enable an article to be dispensed through the outlet opening.

28. The machine of claim 27 wherein a sensor is provided for sensing the position of the latch to determine when the latch accomplishes at least one of releasing the gate and re-locking the gate in the closed position, a second sensor for sensing the position of a second leg member of said pair of leg members as the gate moves to the open position to determine when the gate is in the fully opened position to enable an article to be released through the outlet opening.

29. The machine of claim 27 wherein a spring is provided for biasing the latch into a closed position to secure the gate in the closed position.

30. A vending machine for vending articles, including:

user input means for allowing a user to input information relating to purchase of one of the articles;

payment receiving means for receiving payment relating to purchase of the article;

a vending unit for storing the articles and for dispensing the articles to a purchaser;

control means coupled to the vending unit, the user input means and the payment receiving means for receiving data from the user input means concerning the article to be purchased, determining that payment has been made and for causing the vending unit to dispense the article; and wherein the vending unit includes:

a storage compartment for storing a plurality of the articles;

a carriage mounted below the storage compartment and movable relative to the storage compartment, the carriage having an open bottom;

a floor below the open bottom of the carriage;

an outlet opening in the floor;

moving means for moving the carriage to align the carriage with a particular one of the articles stored in the storage compartment and then to the outlet opening after receipt of the article; and release means for releasing the article from the storage compartment so the article falls under the influence of gravity into the aligned carriage so that the carriage can receive the article and transport the article to the outlet opening with the article sliding on the floor and dropping from the carriage through the outlet opening when the carriage arrives at the outlet opening to thereby dispense the article.

31. The machine of claim 30, wherein the storage compartment includes a plurality of sections, each section being for storing a plurality of articles in a stacked manner one above another.

32. The machine of claim 30, wherein the release means comprises a pivotally mounted latch for holding the articles in each section.

33. The machine of claim 30, wherein the carriage includes a plunger for contacting the latch and moving the latch to release the article so the article can drop into the carriage for transportation to the outlet opening.

34. The machine of claim 33, wherein the plunger includes a solenoid for moving the plunger from a retracted position to an extended position so that in the extended position the plunger engages the latch and pivots the latch out of engagement with the article to enable the article to drop into the carriage.

35. The machine of claim 30, wherein the carriage is coupled to an endless belt and the belt is driven by a stepping motor to drive the carriage beneath the storage compartment into registry with a particular one of the articles stored in the storage compartment.

36. The machine of claim 30, wherein the carriage includes a wheel for facilitating movement of the carriage.

37. The machine of claim 30, wherein the carriage includes:

a sensor for determining the position of the carriage beneath the storage compartment, a sensor for detecting when the carriage is in a home position;

a sensor for determining whether an article is within the carriage; and a sensor for determining whether articles are stored in the storage compartment.

38. The machine of claim 37, wherein the sensors are optical sensors.

39. The machine of anyone of claim 30, wherein the opening is closed by a spring biased closure door which is open by the carriage when the carriage moves into registry with the opening.

40. The machine of claim 30, wherein the user input means comprises a touch screen which displays information so that the user can input commands by touching the screen in response to the information displayed on the screen.

41. The machine of claim 30, wherein the payment receiving means comprises a card reader for receiving a financial transaction card such as a credit card or EFTPOS card or smart card for enabling payment in respect of the article.

42. A vending machine for vending articles, including:

user input means for allowing a user to input information relating to purchase of one of the articles;

payment receiving means for receiving payment relating to purchase of the article;

a vending unit for storing the articles and for dispensing the articles to a purchaser;

control means coupled to the vending unit, the user input means and the payment receiving means for receiving data from the user input means concerning the article to be purchased, determining that payment has been made and for causing the vending unit to dispense the article; and wherein the vending unit includes:

a plurality of storage sections each for storing articles stacked one above another;

a carriage movable relative to the storage sections;

moving means for moving the carriage to align the carriage with a particular one of the articles stored in one of the storage sections;

a latch associated with each of the plurality of storage sections, the latch being pivotally mounted at an intermediate portion of the latch between a top of the latch and a bottom of the latch, a separate engaging component which includes an engaging portion, the engaging component being coupled to the latch by a recess in one of the latch and the engaging component and a boss on the other of the latch and the engaging component engaged in the recess, the engaging portion being for engaging a lowermost one of the articles stacked in one of the storage sections and for holding the articles, and each latch having a retaining portion so that when the latch is moved to withdraw the engaging portion from the lowermost article to release the lowermost article, the retaining portion is moved concurrently into engagement with the article above the lowermost article to hold the article above the lowermost article and any articles above that article so that only the lowermost article is dispensed from the respective storage section and upon return of the latch the retaining portion disengages from the exposed bottom portion so that the articles can drop under the influence of gravity and be held by the engaging portion within that storage section.

43. The machine of claim 42, wherein the carriage is mounted for movement below the sections and includes a plunger for contacting the latch and for moving the latch to release the lowermost article so the article can drop into the carriage for transportation to the dispensing station.

44. The machine of claim 43, wherein the plunger includes a solenoid for moving the plunger from a retracted position to an extended position so that in the extended position the plunger engages the latch and pivots the latch out of engagement with the article to enable the article to drop into the carriage.

45. The machine of claim 42, wherein the carriage is coupled to an endless belt and the belt is driven by a stepping motor to drive the carriage beneath the storage sections into registry with a particular one of the articles stored in one of the storage sections.

46. The machine of claim 42, wherein the carriage includes a wheel for facilitating movement of the carriage.

47. The machine of claim 42, wherein the carriage includes:

a sensor for determining the position of the carriage beneath the storage sections;

a sensor for detecting when the carriage is in a home position;

a sensor for determining whether an article is within the carriage; and a sensor for determining whether articles are stored in the storage sections.

* * * * *